US005752122A

United States Patent [19]

Ishikawa

[11] Patent Number: 5,752,122

[45] Date of Patent: May 12, 1998

[54] COLOR PHOTOGRAPHIC PROCESSING METHOD AND APPARATUS

[75] Inventor: Takatoshi Ishikawa, Minami-Ashigara, Japan

[73] Assignee: Fuji Photo Film Co., Ltd., Kanagawa, Japan

[21] Appl. No.: 659,751

[22] Filed: Jun. 6, 1996

[30] Foreign Application Priority Data

Jun. 9, 1995 [JP] Japan ..... 7-168316

[51] Int. Cl.[6] ..... G03D 3/08

[52] U.S. Cl. ..... 396/612; 396/616

[58] Field of Search ..... 396/612, 622, 396/564, 568, 613, 615, 617, 620, 626, 630; 430/398–400, 357; 226/108, 188, 4

[56] References Cited

U.S. PATENT DOCUMENTS

| | | | |
|---|---|---|---|
| 5,153,108 | 10/1992 | Ishikawa et al. | 430/372 |
| 5,215,874 | 6/1993 | Sakakibara | 430/496 |
| 5,229,259 | 7/1993 | Yokota | 430/523 |
| 5,250,404 | 10/1993 | Sakakibara | 430/523 |
| 5,273,864 | 12/1993 | Ishikawa et al. | 430/587 |
| 5,336,589 | 8/1994 | Mukunoki et al. | 430/501 |
| 5,573,896 | 11/1996 | Carli et al. | 430/399 |

FOREIGN PATENT DOCUMENTS

| | | |
|---|---|---|
| 63146705 | 1/1989 | Japan . |
| 233147 | 2/1990 | Japan . |
| 2245751 | 10/1990 | Japan . |
| 2271354 | 11/1990 | Japan . |
| 3154044 | 7/1991 | Japan . |
| 4141645 | 5/1992 | Japan . |
| 4141646 | 5/1992 | Japan . |
| 8 22110 | 1/1996 | Japan . |
| 822110 | 1/1996 | Japan . |

*Primary Examiner*—D. Rutledge
*Attorney, Agent, or Firm*—Birch, Stewart, Kolasch & Birch, LLP

[57] ABSTRACT

A color photographic processing apparatus in which a color film processing apparatus, a printer and a color paper processing apparatus are installed in a casing is provided. The sum of a length of a path from an entrance of a developing tank to a discharge port of a drying station of the color film processing apparatus and a length of a path from an entrance of a developing tank to a discharge port of a drying station of the color paper processing apparatus is in the range of 950 mm to 10,000 mm. The time from insertion of a film into the color film processing apparatus to discharge of 25th print is less than 10 minutes. The values of the ratio given by the following equation are from 120 to 330 for the color film, and from 20 to 120 for the color paper;

length of path (mm)/conveying speed (mm/sec.).

28 Claims, 6 Drawing Sheets

MODIFIED PPE: COEFFICIENT OF LINEAR EXPANSION: $5.3 \times 10^{-5}$ Cm/Cm °C

MODIFIED PPE: COEFFICIENT OF LINEAN EXPANSION ; $7.5 \times 10^{-5}$ Cm/Cm °C

COLOR PHOTOGRAPHIC PROCESSING METHOD AND APPARATUS

FIELD OF THE INVENTION

Present invention relates to color photographic a processing method and apparatus which are capable of performing color photographic processing. The present invention is further drawn to a color photographic processing method and apparatus which have a superior processing performance and less drawbacks in transportation of materials to be processed.

BACKGROUND OF THE INVENTION

Processes (develop-printing (DP) processes) for obtaining finished prints from exposed color negative film include generally three steps of a) a step of processing the color negative film, b) a step of printing images on the color negative film onto a color paper and c) a step of processing the color paper. These processes are collectively carried out by laboratories located at various locations. However, nowadays, storefront processing apparatus called mini-labs are seen. In general, the mini-lab has two processing apparatuses, one of which is a film processing apparatus for processing the color negative films, and the other of which is a printer-processor which performs the printing step and the step of processing color paper successively. However, it is difficult to install such two processors in a small floor space in a store. Accordingly, a processing apparatus which has a small installing floor space and a high processing capacity is obviously desired.

Factors which affect the size of a processing apparatus are considered to be processing time, processing capacity (size of processing tanks), replenishing tanks, discharge tanks and the like. The processing time affects the size of a processing tank directly, and therefore, reduction of the processing time is an effective means to make the size of a processing apparatus compact.

Japanese Patent Application Laid Open Nos. 64-15741 and 4-141645 disclose processing apparatuses in which a film processing apparatus, a printer and a paper processing apparatus are integrally consolidated. These processing apparatuses are advantageous to make processing apparatuses compact. The present invention provides a technology for shortening the processing time to allow processing apparatus more compact.

Further, in the above-described consolidated processing apparatus, the negative film is transferred to the next step and the printing is carried out successively after the negative film has been processed without checking the quality of the processed negative film. Consequently, prints of inferior quality may be provided. Accordingly, in this type of processing apparatus, a design which does not cause scratches or stains on the printed paper is required.

The present invention is to provide a color photographic processing method and apparatus which can produce prints having a highly improved quality.

Furthermore, waiting time for obtaining finished prints in a develop-printing process (DP process) is 30 minutes at shortest, or on a degree of one hour in the above-described storefront processing. Accordingly, a customer can rarely receive finished prints while the customer is waiting at the storefront. Consequently, one of the objects of the present invention is to provide a super rapid photofinishing process in which processing time for one order is reduced. By achieving the object above, a color photographic processing method and apparatus which enable a customer to receive finished prints while the customer is waiting at the storefront are provided.

SUMMARY OF THE INVENTION

An object of the present invention is to provide a compact color photographic processing apparatus which is capable of develop-printing in a short time, and further, to provide a compact color processing apparatus which has a superior processing performance and less drawbacks in transportation of materials to be processed.

Another object of the present invention is to provide a method for obtaining finished prints having a superior quality in a short time.

The inventor of the present invention has studied extensively and found that the above objects can be achieved by method and the apparatus described hereinafter.

The present apparatus in which a color film processing apparatus, a printer and a color paper processing apparatus is one are built-in in a casing, characterized in that the sum of a length of a path from an entrance of a developing tank to a discharge port of a drying station of the color film processing apparatus and a length of a path from an entrance of a developing tank to a discharge port of a drying station of the color paper processing apparatus is from 950 mm to 10,000 mm, and a processing time from insertion of an exposed color negative film into the color film processing apparatus to discharge of the 25th finished prints or equivalent thereto through the processing of the color negative film, the print-exposure onto the color paper and the processing of the color paper is less than 10 minutes.

The processing method and apparatus according to the present invention preferably comprise processing time from the insertion of an exposed color film into the color film processing apparatus to the discharge of finished prints through the processing of the color film, the print-exposure onto the color paper and the processing of the color paper from 5 to 8 minutes.

The processing method and apparatus according to the present invention preferably comprise a length of a path from an entrance of a developing tank to a discharge port of a drying station of the color film processing apparatus is from 750 mm to 4,500 mm and conveying speed of a color film from 5 mm to 20 mm per second.

Further, the processing method and apparatus according to the present invention preferably comprise a length of a path from an entrance of a developing tank to a discharge port of a drying station of the color paper processing apparatus is from 900 mm to 4,500 mm, and conveying speed of a color paper from 12 mm to 100 mm per second.

Furthermore, the processing method and apparatus according to the present invention preferably comprise a length of a path from an exit of the color film processing apparatus to an entrance of a printer from 100 mm to 1,000 mm, and a conveying speed of a color film is from 5 mm to 20 mm per second.

Moreover, the processing method and apparatus according to the present invention, are preferably constituted such that a color film is conveyed by guide rollers and guides.

In addition, the processing apparatus according to the present invention, has a reading means for reading information recorded on a magnetic recording layer on a color film in the casing of the apparatus. According to the structures above, the sum of the length of the path from the entrance of the developing tank to the discharge port of the drying station of the color film processing apparatus and the length of the path from the entrance of the developing tank to the discharge port of the drying station of the color paper processing apparatus is from 950 mm to 10,000 mm, and the conveying speeds of the color film and the color paper are adjusted within the range of the length of the paths so that the totalized processing time from insertion of an exposed color film into the apparatus until discharge of the 25th or equivalent thereto of the printed color paper through the processing of the color film, the print-exposure and the processing of the color paper can be less than 10 minutes.

DETAILED DESCRIPTION OF THE INVENTION

The color photographic processing apparatus which can be used in the present invention is described in detail hereinafter.

The color processing apparatus of the present invention is a so-called consolidated processing apparatus in which a color film processing apparatus, a printer and a color paper processing apparatus are installed together. Various methods have been proposed to install two processing apparatuses, i.e., a color film processing apparatus and a color paper processing apparatus. For example, Japanese Patent Application Laid Open No. 2-33147 and FIG. 2 of Japanese Patent Application Laid Open No. 4-141646 disclose a layout in which one processing apparatus is in line with the other processing apparatus and a printer is disposed therebetween. Further, FIGS. 1 and 4 of Japanese patent Application Laid Open No. 2-271354 disclose an apparatus in which a processing tank is superposed on another in two layers. FIG. 2 of Japanese Patent Application Laid Open No. 4-141645 and FIG. 1 of Japanese Patent Application Laid Open No. 3-154044 disclose apparatuses in which two processing lines are at right angles each other. Further, FIG. 1 of Japanese Patent Application Laid Open No. 2-245751 shows a specification in which two processing lines are in parallel with each other.

In the present invention, various arrangements as described above can be used. However, for the purpose of making the apparatus as compact as possible, it is most preferable that two processing lines are in parallel with each other. This is also advantageous when processing solutions for the color film processing apparatus are in common with those for the color paper processing apparatus.

Preferred embodiments of the processing method and the processing apparatus are described thereinafter, but the present invention is not limited to these embodiments.

Figure 1:
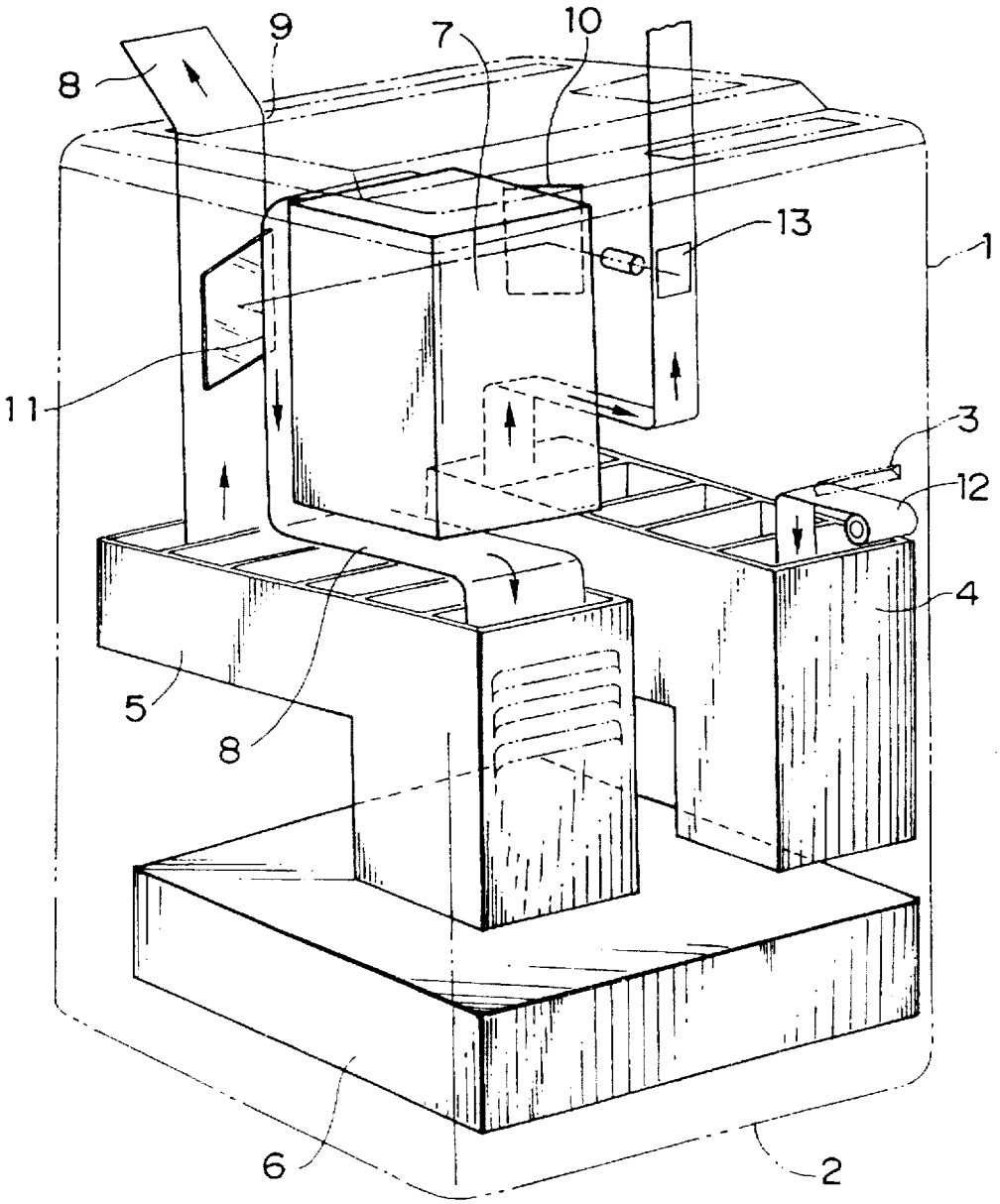
FIG. 1 is a schematic perspective view of an embodiment of a processing portion of a color photographic processing apparatus according to the present invention.

FIG. 1 is a schematic perspective view of an embodiment of a processing portion of a color photographic processing apparatus in which processing solutions for the color film processing apparatus are in common with those for the color paper processing apparatus. Numeral 1 denotes a casing and numeral 2 denotes the front side of the casing 1. A color film processing apparatus 4 is disposed at the side of a film insertion entrance 3, and a color paper processing apparatus 5 is disposed in parallel with the color film processing apparatus 4. The color film processing apparatus 4 and the color paper processing apparatus 5 are communicated with a replenishing solution tank and a discharge solution tank portion 6, respectively. The discharge solutions from the color film processing apparatus 4 and the color paper processing apparatus 5 are discharged into the replenishing and discharge solution tank portion 6, and the replenishing solution (developing solution) is replenished from the replenishing solution tank of the replenishing and discharge solution tank portion 6 to the color film processing apparatus 4 and the color paper processing apparatus 5 as occasion demands. A color paper 8 for color printing is supplied from a paper cartridge 7 disposed above the color paper processing apparatus 5 to the color paper processing apparatus 5, and the processed color paper is conveyed from a color paper exit 9 to the outside of the color photographic processing apparatus. The film 12 is inserted into the color photographic processing apparatus from the film insertion entrance 3, and conveyed into the color film processing apparatus 4. The processed color film 12 is conveyed to an exposing station 13 through a drying zone. The color paper conveyed from the paper cartridge 7 is exposed by a light passed through an image on the color film 12 and reflected by a mirror 10 and a mirror 11. The imagewisely exposed paper 8 is conveyed to the color paper processing apparatus 5 and processed. The processed paper is taken out from a processed paper exit 9 through a drying zone to the outside of the color photographic processing apparatus.

Figure 2A:
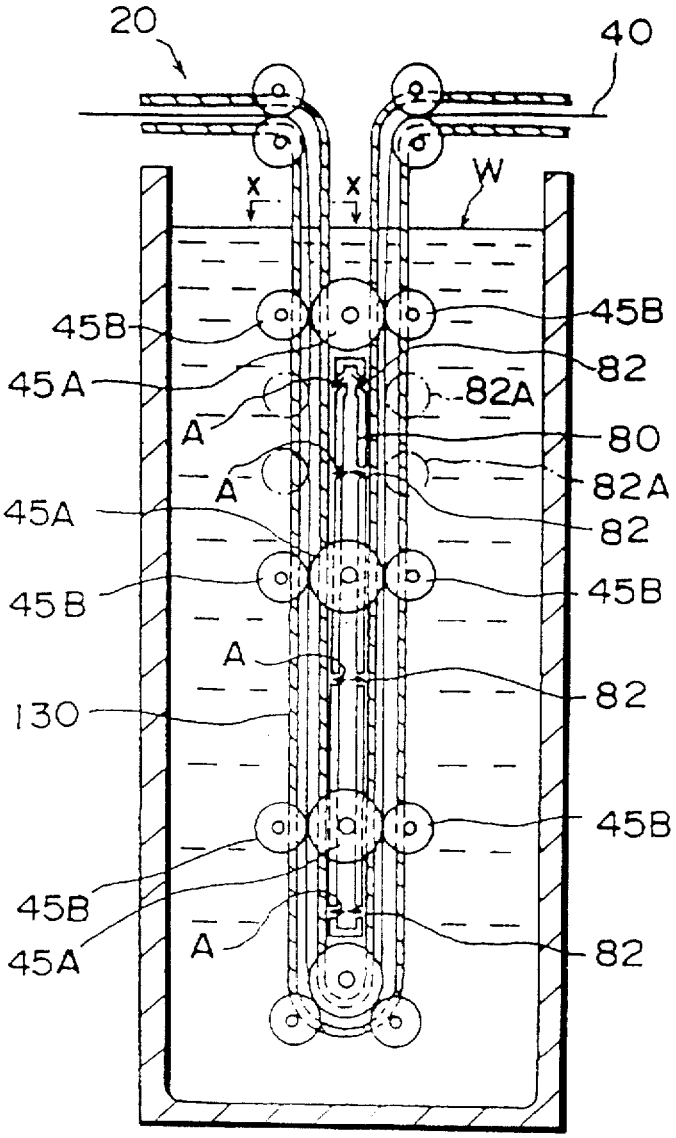
FIG. 2A is an enlarged vertical cross-sectional drawing of a developing tank of a color film processing apparatus which is applicable to the color photographic processing method and the color photographic processing apparatus according to the present invention.
Figure 2B:
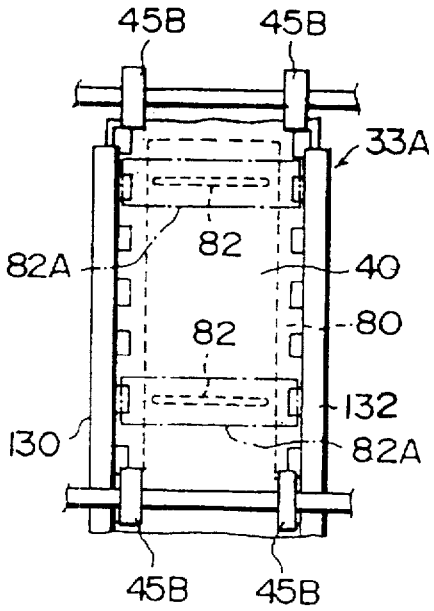
FIG. 2B is an enlarged vertical cross-sectional view of a groove of a guide.
Figure 2C:
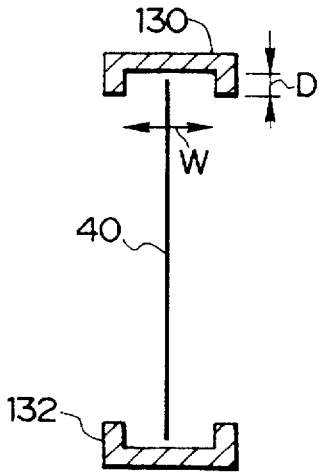
FIG. 2C is an enlarged horizontal cross-sectional view of the groove of the guide taken along the line X—X.

In the above-described color photographic processing apparatus, an apparatus as shown in FIGS. 2A, 2B and 2C is preferred as the color film processing apparatus 5. In this color film processing apparatus, a jet stream agitation is performed from the inside of a U-shaped moving path of the film. FIG. 2A shows a vertical cross-sectional drawing of an embodiment of a processing tank in which the emulsion layer of the film 40 faces in the inward direction of the U-shaped moving path, and the jet stream agitation is performed between the U-shaped moving path of the film 40. A side view of a conveying path of a film guided by guides is also shown in FIG. 2A. A cross-section of plates 130 and 132 which constitute a guide groove is shown in FIG. 2B. FIG. 2C is a cross-sectional drawing of the guide, taken along the line X—X, where D is the depth of the groove of the guide and W is the inner width of the groove of the guide. A plurality of conveying rollers (drive rollers) 45A and 45B made of rubber are disposed along the conveying path formed by the guide groove. These rollers are arranged so as to correspond to the perforated portions at the both sides of the film, the portions being outside of image areas of the film. The rollers are rubber rollers of approximately 3 mm in width and mounted on drive shafts. The film 40 is conveyed by the rotation of the rollers driven by a drive source. The rubber rollers 45A and 45B contact only the portions in the vicinity of perforated guide holes at the both sides of the film 40 and do not contact the emulsion surface at the image areas of the film 40.

A box body 80 having an opening 82, as a means for the jet stream agitation, is disposed in the U-shaped conveying path of the film as shown in FIG. 2A and communicated with a pressure pump (not shown) via a pipe toward the direction perpendicular to the paper surface. The opening 82 of the box body 80 is formed such that the longitudinal direction of the opening 82 is the transverse direction of the film 40. The opening shaped like a slit, from which a jet stream is blown out is disposed between the drive rollers 45A arranged in the vertical direction. The developing solution in a developing tank 20 is sent into the box body 80 with pressure and sprayed from the opening 82 of the box body 80 toward the surface of the emulsion layer inside of the U-shaped conveying path of the film 40 in the direction of arrow A. The opening 82 in the vicinity of the surface W of the processing solution is inclined in the direction being apart from the surface W.

Further, when a film having a track of a magnetic recording layer, on which information regarding types of film, information regarding customer's order such as numbers of prints, and information regarding user such as a customer's ID and the like can be recorded, is processed a magnetic signal reading and writing device is preferably installed at the interior of the color photographic processing apparatus.

Figure 3:
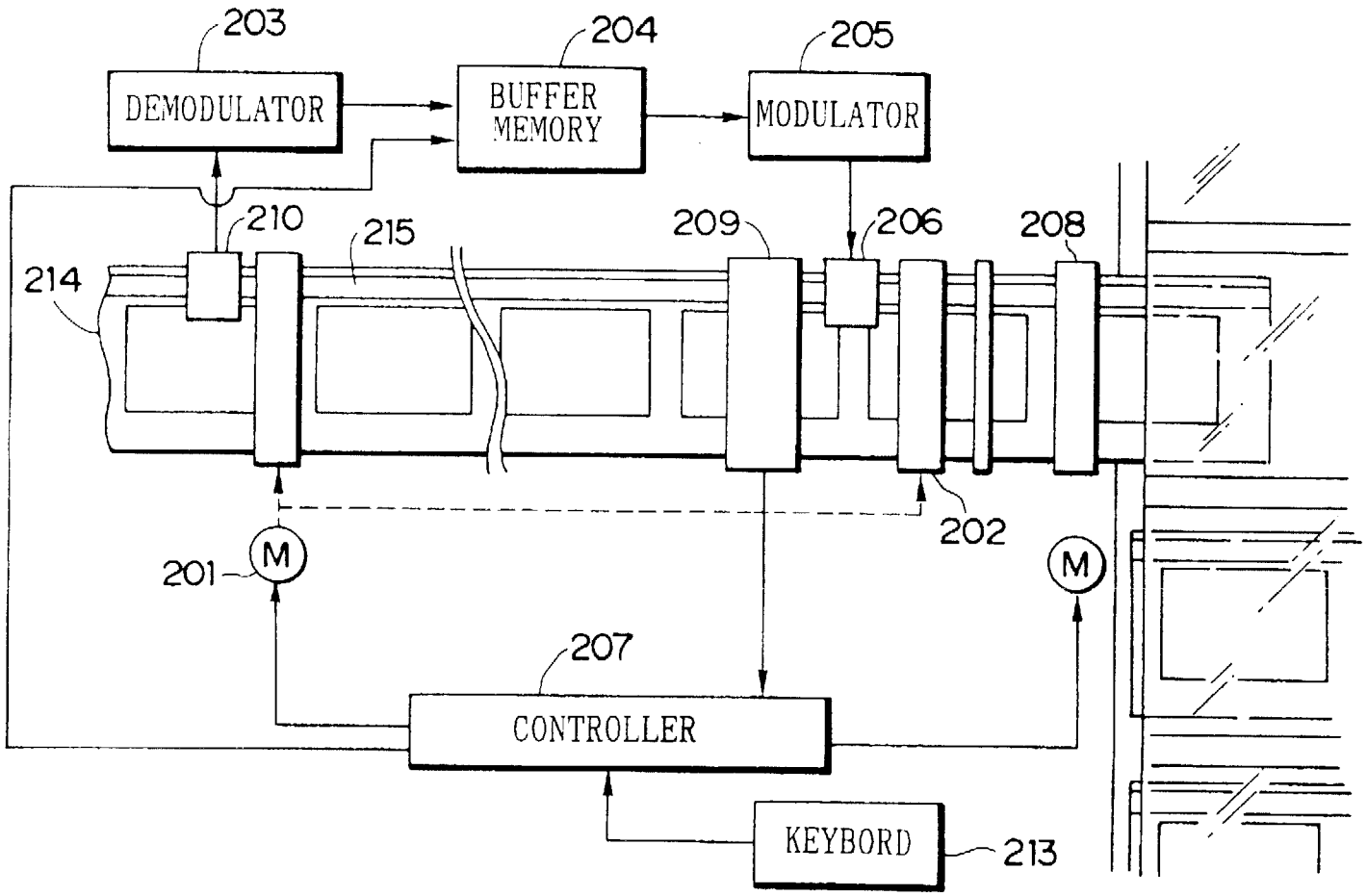
FIG. 3 is a drawing of a main portion of a reading and writing device for magnetic signals which is applicable to a color photographic processing apparatus according to the present invention.

A main part of a film conveying device to which the above-described magnetic signal reading and writing device is applied is shown in FIG. 3. In FIG. 3, the film 214 having a track 215 on which a magnetic signal is recorded is conveyed by pairs of rollers 202, between which the film 214 is nipped, driven by a motor 201. A magnetic head 210 contacts the track 215 disposed in parallel with the longitudinal direction of the film 214 and reads information recorded on the track 215 for each frame of the film 214 and information recorded at the leading end of the film 214. Output signals from the magnetic head 210 are demodulated into digital signals by a demodulator 203 and stored in a buffer memory 204. Meanwhile, information necessary for each frame and information to be inputted to the leading end and the trailing end of the film 214 are transmitted to the buffer memory 204 via a controller 207 from a keyboard 213, and the inputted information is combined with the read information.

Next, a writing position on the film 214 is detected by a frame detection portion 209 and the information from the buffer memory 204 is converted in accordance with a recording method of the film 214 by a modulator 205. The converted information is then written onto the track 215 by a magnetic head 206. The information may be written onto the track 215 which was used during exposure of the film 214, but may be written onto another track which may be separately provided.

In the processing apparatus according to the present invention, time from the insertion of a film to the completion of develop-printing, that is, time from the insertion of one roll of film into the processing apparatus to discharge the 25th or equivalent thereto of prints for the roll of film, is less than ten minutes. The time required for one roll of film means the time from the insertion of one roll of film on which 25 frames of images or equivalent thereto are normally exposed until the discharge of 25 finished prints or equivalent thereto of L-size (127 mm×89 mm) from the frames. The time is preferably from 3 to 8 minutes.

Further, it is preferable that the processing apparatus of the present invention is compact, and a preferred floor space of the apparatus is less than 1 $m^2$, more preferably from 0.3 to 0.8 $m^2$. The floor space means a projection area of the processing apparatus, and does not include spaces for maintenance and operation.

For the purpose of achieving the photofinishing in a short period of time and the compact size of the processing apparatus, the conveying distance (the length of path) for the color film and the color paper is preferably as short as possible, and it is necessary that the sum of the length of the path between the entrance of the developing station and the exit of the drying station of the color film processing apparatus, and the length of the path between the entrance of the developing station and the exit of the drying station of the color paper processing apparatus is from 950 mm to 10,000 mm. If the sum of the length of the paths is less than 950 mm, it is difficult to obtain high quality finished color prints by adjusting the conveying speed of the color film in the color film processing apparatus and the conveying speed of the color paper in the color paper processing apparatus. On the other hand, if the sum of the length of the paths exceeds 10,000 mm, reduction of the processing time becomes difficult.

The adjustment of the length of the conveying paths can be achieved by making the length of the rack in the processing tank adjustable. The length of the path from the entrance of the developing station to the exit of the drying station of the color film processing apparatus is, for example, from approximately 750 mm to 4,500 mm, preferably, from approximately 1,500 mm to 4,500 mm, more preferably, from approximately 2,000 mm to 4,000 mm. The entrance of the developing station means the position where the color film contacts with the developing solution, and the exit of the drying station means the position where the color film comes out of the drying zone to the exterior of the color film processing apparatus.

The images on the color film are printed onto the color paper by a color printer and the exposed color paper is then conveyed to the color paper processing apparatus. It is desirable that the series of these operations are successively and automatically carried out. Further, it is desirable that the distance from the exit of the drying zone of the color film processing apparatus to the insertion of the exposed color paper into the color paper processing apparatus is short. Namely, the sum of the distance from the exit of the drying zone of the film processing apparatus to the printing station for printing the images on the color film onto the color paper, and the distance from the printing station to the position where the exposed color paper contacts the color paper developing solution is less than 2,000 mm, preferably from 200 mm to 1,500 mm. However, it is not desirable that when the distance between the exit of the drying zone of the film processing apparatus and the printing station is too short, problems in shift of hue of colors of the color film, so-called thermochromism, due to the heat during drying occur.

The length of the path from the entrance of the developing station to the exit of the drying station of the color paper processing apparatus is from approximately 900 mm to 4,500 mm, preferably, from approximately 1,500 mm to 4,500 mm, more preferably, from approximately 2,000 mm to 4,000 mm. The entrance of the developing station means the position where the color paper contacts with the developing solution, and the exit of the drying station means the position where the color paper comes out of the drying zone to the exterior of the paper processing apparatus.

Furthermore, the conveying speeds of the color film and the color paper through the above-described paths and the printing speed are important for the purpose of reduction of time for the photofinishing. The conveying speeds of the color film and the color paper can be adjusted by changing rotation speed of a variable speed motor in the drive unit of the conveying mechanism of each of the processing apparatuses.

The conveying speed of the color film in the color film processing apparatus is from 5 mm to 20 mm/second, preferably from 10 mm to 20 mm/second, in view of the reduction of time for the photofinishing, the prevention of scratches and stains of the color film, and prevention of failure in conveyance of the film, more preferably from 12 mm to 18 mm/second. When the conveying speed is slower than the above-described range, failures in conveyance and stains tend to occur. Then the conveying speed is faster than the above-described range, scratches of the film tend to arise. Moreover, when the conveying speed of the film having a magnetic recording layer is within the above range, the accuracy in reading magnetic recorded information is highest.

With regard to the relationship between the length of the conveying path of the color film and the conveying speed of the color film, in the following equation:

Length of the path of film (mm)/Film conveying speed/sec.=NV when the value of NV is from 120 to 330, preferably from 150 to 270, the specification of the film processing apparatus is the most preferable.

The conveying speed of the color paper in the color paper processing apparatus is from 12 mm to 100 mm/second, preferably from 20 mm to 100 mm/second, in view of the reduction of time for photofinishing, and the whiteness of non-image areas of the processed paper and the stability of the image color of the processed paper. The most preferred range of the conveying speed is from 25 mm to 80 mm/second. When the conveying speed is slower than the above-described range, the whiteness of non-image areas of the processed paper and the stability of the image color may be deteriorated. When the conveying speed is faster than the above range, scratches on the paper may be caused, and deterioration of components in washing water or a stabilizing solution due to oxidization by air is accelerated. As a result, the white background of non-image areas may become yellowish.

With regard to the relationship between the length of the conveying path of the color paper and the conveying speed of the color paper, in the following equation:

Length of the path of paper (mm)/Paper conveying speed/sec.=PV when the value of PV is from 20 to 120, preferably from 30 to 90, the specification of the paper processing apparatus is the most preferable.

Next, the conveying method of the film processing apparatus according to the present invention will be described hereinafter.

When a film is conveyed along the guides, which support both edges of the film and disposed along the direction of conveyance of the film according to the present invention, preferable conveying characteristics of the film processing apparatus, and preferable effects on preventing scratches and stains of the film are well exhibited. The most preferred ranges of the inner width (D) of the groove of the guide is from 0.5 mm to 5.0 mm and the depth of the groove of the guide is from 2 mm to 5 mm.

Since troubles in transportation of the film and scratches of the film are rarely caused when the coefficient of linear expansion of material for constituting the guide is less than $6\times10^{-5}$ (cm/cm °C.)and more than $-1.0\times10^{-5}$ (cm/cm °C.), this range is preferred. Examples of such materials are preferably polymer compounds. Embodiments of the polymer compounds are compounds containing poly (2,6-dimethylphenyleneoxide) as a main component such as polyphenyleneether resins (hereinafter referred to as PPE) and polyphenyleneoxide resins (hereinafter referred to as PPO) and the like. These compounds can be used alone as a homopolymer, or can be used as a polymer alloy by modifying with other resins.

Examples of the polymer alloys are the polymer alloys of PPE, PPO and the like with stylene resins, polyamide resins (PA), polyolefine resins, polybutylenetelephthalate resins, polyphenylenesulfide resins and the like. The polymer alloy in the present invention is a high molecular multi-component system, in which different types of polymers coexist microscopically, which includes block coplolymers, graft coplolymers and polymer blend. As the polymer alloys, modified polyphenyleneether (hereinafter referred to as modified PPE) which includes stylene-grafted polyphenyleneether resin alloyed with stylene resin and modified polyphenyleneoxide (hereinafter referred to as modified PPO) can preferably be used. These types of polymer alloys which are commercially available include: Nolyl (tradename) made by Nippon GE Plastics; Zaylone (tradename) made by Asahi Kasei Kogyo; and Yupiace (tradename) made by Mitsubishi Gas Chemical. The polymer alloys which include polyamides such as nylon are: Zaylone (tradename) made by Asahi Kasei Kogyo; Lynex A (tradename); Sumitomo SPA (tradename) made by Sumitomo Chemicals; and Artlee (tradename); and Remalloy (tradename) made by Mitsubishi Yuka and the like. The polymer alloys which include polyolefine resins such as polypropylene resins, or polybutylenetelephthalate resins are: Yupiace (tradename) made by Mitsubishi Gas Chemicals; and Dialloy (tradename) made by Mitsubishi Rayon and the like. The polymer alloys which include polyphenylenesulfide resins are: Yupiace (Tradename) made by Mitsubishi Gas Chemicals and the like.

The polymer alloys which can most preferably be used in the present invention are modified PPE, modified PPO and polyphenylenesulfide resins (hereinafter referred to as PPS) which are modified with stylene resins. The coefficients of linear expansion of the PPE modified with stylene, and the modified PPO and PPE/PPS polymer alloy in the above are changed depending on the content of PPE component.

In the following general formula:

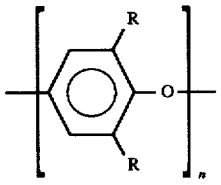

wherein R represents an alkyl group, and n represents an integer from 10 to 1,000,1000. The lesser contents of the polyphenyleneether represented by the above general formula, the higher coefficient of linear expansion. The coefficient of linear expansion of polyphenyleneether which is not modified is from $2.7\times10^{-5}$ to $3.1\times10^{-5}$ (cm/cm °C.), but the thermal deformation temperature is 193° C. Since the temperature is too high and there is a problem in molding characteristics, the modified polyphenyleneether modified with stylene is used. There is a tendency that the coefficient of linear expansion becomes higher when mixing ratio of stylene is higher. When the mixing ratio with stylene increases and the coefficient of linear expansion exceeds $6.0\times10^{-5}$ (cm/cm °C.), the polyphenyleneether cannot preferably be used in the present invention. In such case, the mixing ratio is adjusted so as to reduce the coefficient of linear expansion, but the coefficient of linear expansion may be reduced by mixing glass fiber and other fillers.

In the present invention, it is desirable that the coefficient of linear expansion of material constituting the guides is in the range of less than $6\times10^{-5}$ (cm/cm °C.) and more than $-1.0\times10^{-5}$ (cm/cm °C.). The polymer alloy which is made by modifying a resin as a base material, or which is made from two or more resins to obtain desired fabricating characteristics or thermal properties is not suitable for a material constituting the guides, if the coefficient of linear expansion is outside of the above range. Accordingly, in such case, the coefficient of linear expansion is adjusted by adding glass fiber or other inorganic filler to the polymer compound. For example, when PPE is modified with polystylene (hereinafter referred to as PS), the coefficient of linear expansion and the thermal deformation temperature are changed as shown in the following table. The coefficient of linear expansion and the thermal deformation temperature are measured in accordance with ASTM D696 and ASTM D648 (18.6 Kg/cm), respectively.

| | Coefficient of Linear Expansion | Thermal Deformation Temperature |
|---|---|---|
| PPE (not modified) | $2.7–3.1\times10^{-5}$ cm/cm °C. | 193° C. |
| Modified PPE (without Filler) | $7.5\times10^{-5}$ cm/cm °C. | 100° C. |
| Modified PPE (reinforced with 10% glass fiber) | $5.0\times10^{-5}$ cm/cm °C. | 100° C. |
| Modified PPE (reinforced with 20% glass fiber) | $4.0\times10^{-5}$ cm/cm °C. | 103° C. |
| Modified PPE (reinforced with 30% glass fiber) | $3.0\times10^{-5}$ cm/cm °C. | 105° C. |

Figure 4A:
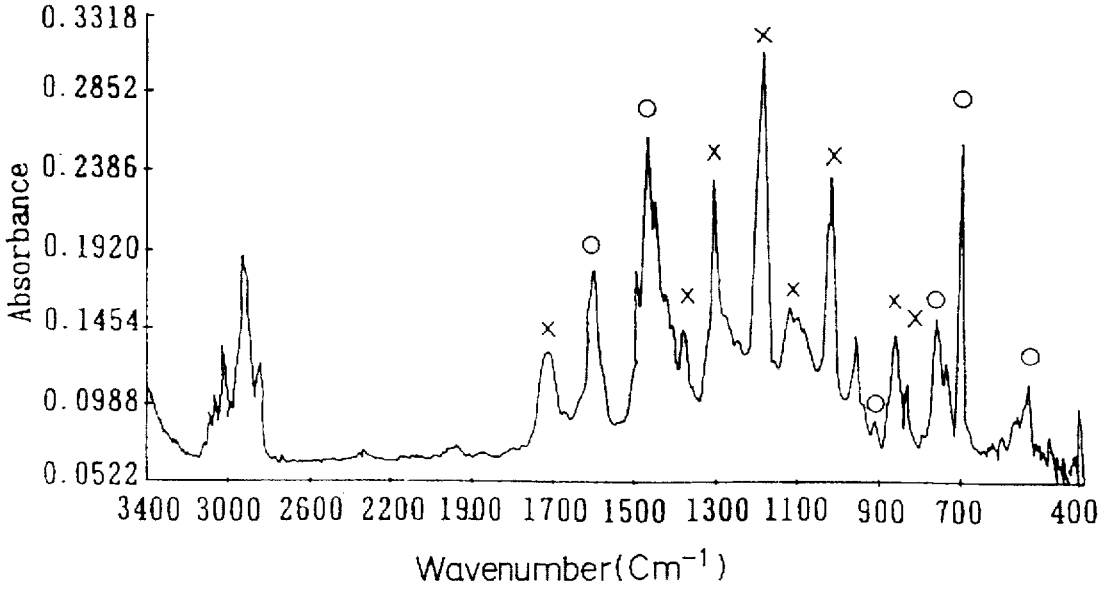
FIGS. 4A and 4B are a chart showing infra-red absorption spectra of polyphenylenephenylether modified with polystylene.
Figure 4B:
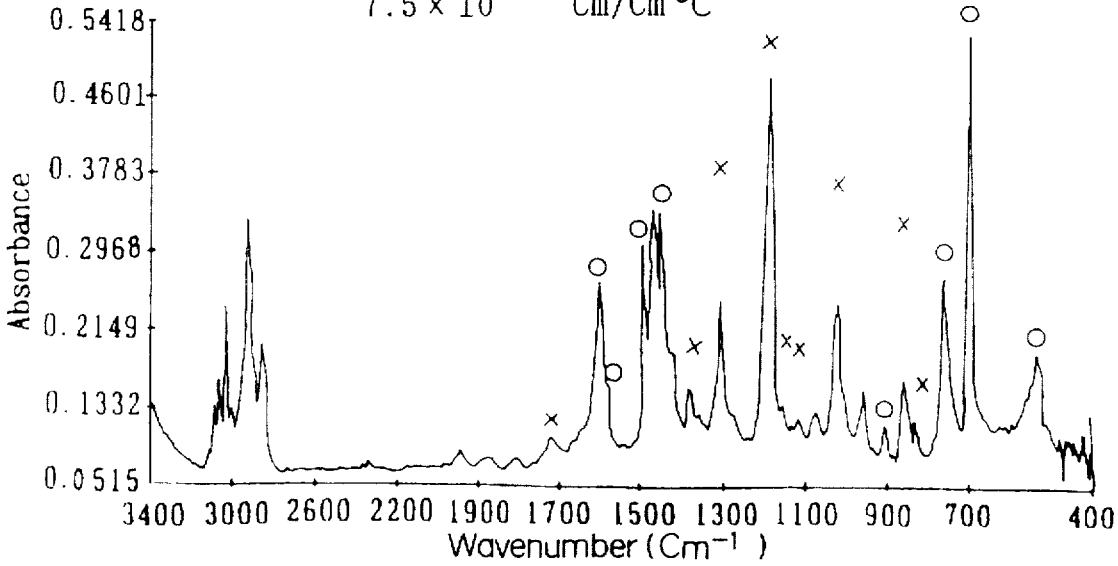

In the present invention, when polymer compounds containing a polymer which can preferably used for materials constituting the guide and have the repeating unit represented by the general formula (I) above is modified with PS, it is preferred that the contents of PS in PPE as a base material is as small as possible, as far as preferred modifying characteristics can be obtained, in case that the above-described glass fiber or inorganic filler is not used. FIG. 4A shows an infrared absorption spectrum of PPE modified with PS having a coefficient of linear expansion of $5.3\times10^{-5}$ cm/cm °C., and FIG. 4B shows an infrared absorption spectrum of PPE modified with PS having a coefficient of linear expansion of $7.5\times10$ $cm^{-5}$/cm °C. As shown FIGS. 4A and 4B, the content of PS can be determined by comparing the height of the first absorption peak of PS with that of PPE. In these spectra, the peaks of PPE are marked with x and the peaks of PS are marked with ○. When a resin of PPE modified with PS without a filler is used as a material for the guide, it is preferred that the height of the first absorption peak of PPE is higher than that of PS, as shown in FIG. 4A.

The foregoing are similar to the polymer alloy with polyamide resins. The polymer alloy in which polyamide resin such as 6-nylon is added to PPE can be used as a material constituting the guide in the present invention, by adjusting the coefficient of linear expansion to a predetermined range in such a manner that a filler such as glass fiber is added to the alloy. However, in the polymer alloy with polyamide resins, the coefficient of water absorption is increased when the content of the polyamide resin is high so that the accuracy in dimensions is changed, and therefore, caution must be taken in blending ratio thereof.

Polymer alloys with polyolefin resins such as polypropyrene and polybutylenetelephtalate resins can be used as materials constituting the guide in the present invention, since these polymer alloys have a lower coefficient of water absorption and a higher shock resistance than those of the above-described polymer alloys with polyamide resins. In this instance, the coefficient of linear expansion must be adjusted to a preferred range by adjusting the blending ratio of the resins or by adding filler.

Polymer alloys of PPE and PS are not deteriorated in its physical properties. Accordingly, this polymer alloy can preferably be used as the material constituting the guide in the present invention.

As described above, when materials having a preferred coefficient of linear expansion as materials constituting the guide for the processing apparatus in the present invention are selected from resins of high productivity, modified PPE and PPE/PPS polymer alloys are preferred, in particular, modified PPE/PPS polymer alloys are also preferred in view of their molding characteristics.

In the present invention, the inner width of the groove of the guide is more than 0.5 mm and less than 5.0 mm, more preferably, more than 1.0 mm and less than 3.0 mm. When the inner width of the groove of the guide is less than 0.5 mm, the processing solution or the oxidized products thereof are apt to deposit in the vicinity of the boundary surface between the processing solution and air so that the groove portion is clogged. When the inner width of the groove is more than 5.0 mm, the stability in conveying the photosensitive material is deteriorated. Accordingly these ranges of the width are not preferred. The depth of the groove of the guide is more than 2 mm and less than 5 mm, more preferably, more than 2.5 mm and less than 4.5 mm. When the depth of the groove is less than 2 mm, the photosensitive material is apt to disengage from the guide. When the depth of the groove is more than 5 mm, the image areas of the photosensitive material are damaged and resistance in conveyance of the photosensitive material is unnecessarily increased. Accordingly, these ranges are not preferred.

The opening portion and the interior of the groove of the above-described guide can be molded with corner radii, or the corner portions can be smoothed with a taper. It is preferred that the corner portions are smoothed by chamfering with 0.1R or more so that deposits of a high concentrated developing agent or oxidized products thereof can be prevented and damages of the photosensitive material can be prevented.

It is preferred that the apparatus in the present invention has a function to judge an abnormality in film processing by measuring densities of a film after the film processing, during print-exposure, or before or after print-exposure. That is, densities in unexposed areas of the film, or an average density of a pictorial image are calculated, thereby the processing is judged as to whether the processing is normal or abnormal on the basis of predetermined standard densities. When the processing is judged to be abnormal, it is preferred that the abnormality is announced and the succeeding film processing is immediately stopped. In particular, in the case that the length of path is as short as 1,500 mm to 4,500 mm in the present invention, when a first film reaches the printer station, the succeeding film is not loaded into the apparatus, or at most two succeeding films are loaded into the apparatus. Accordingly, an abnormality of film processing is detected with the first film and the load of the succeeding films can be prevented so that damages can be stove off at the minimum.

When processing characteristics are judged by detecting the density of film as described above, it is preferred that the measurements of the density of the types of the films which are most commonly used are carry out. Further, it is most preferred that the density of a film is read by a scanner as a method of the density measurement. However, the quantity of light transmitted through a film, or the time required for print-exposure may be detected.

As the printer in the present invention, printers generally used can be used. However, printed papers are preferably cut into each frame and conveyed one by one. In this method, a stock space (a reservoir) for the printed paper is not required so that the processing apparatus is suitable for achieving one of the objects of the present invention that the processing apparatus is made to be compact.

The paper web may be cut and exposed before printing, or may be processed after exposure and cutting. In this system, the exposed paper can be conveyed to the processing station upon occasion, and therefore, a first finished print can be obtained in a short period of time, and this method is advantageous for making the apparatus compact.

The film processing and the paper processing of the present invention are described in detail hereinafter.

Figure 5A:
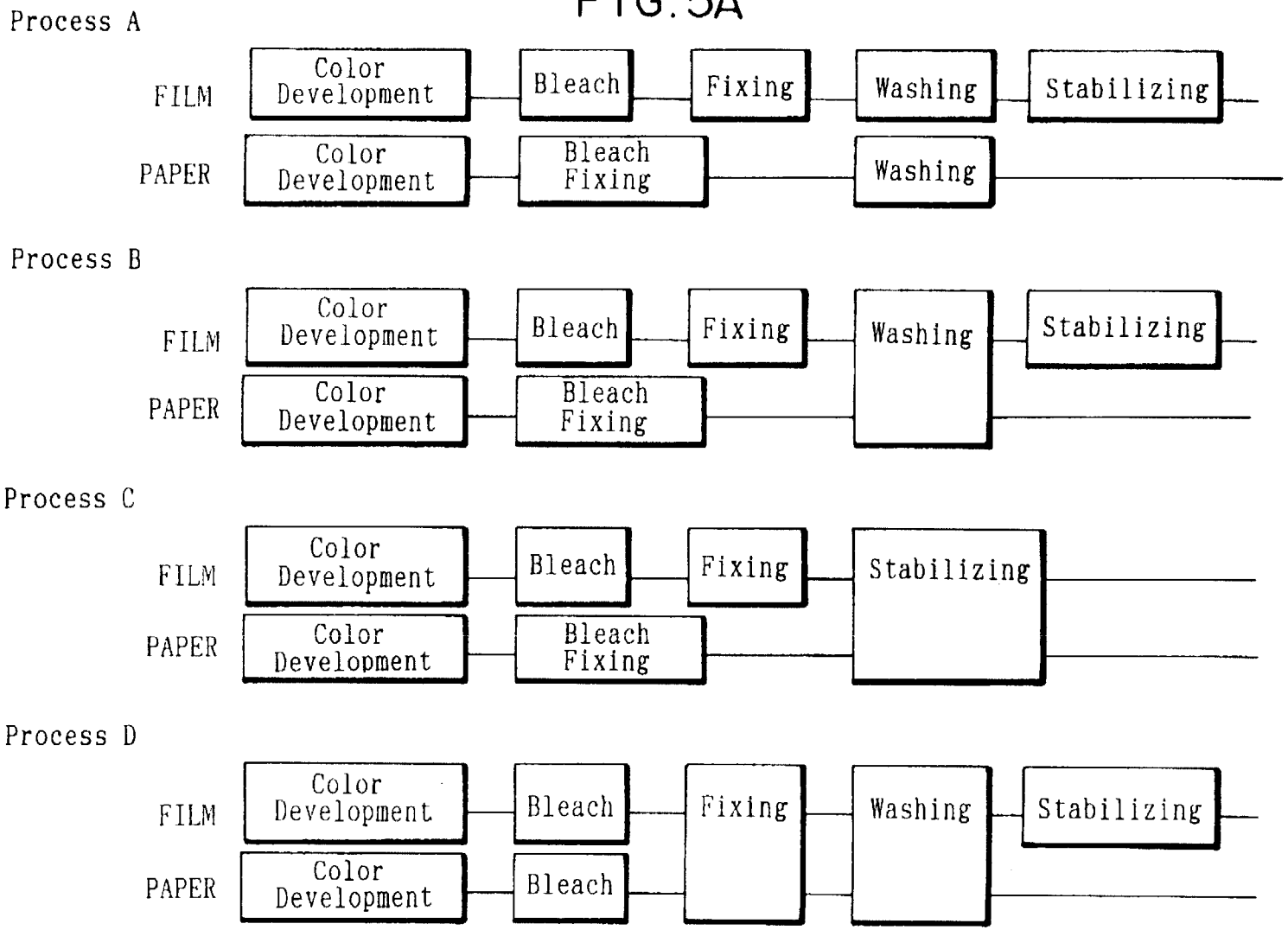
FIGS. 5A and 5B show process flow charts showing examples of processes which are applicable to the processing method and the processing apparatus according to the present invention.
Figure 5B:
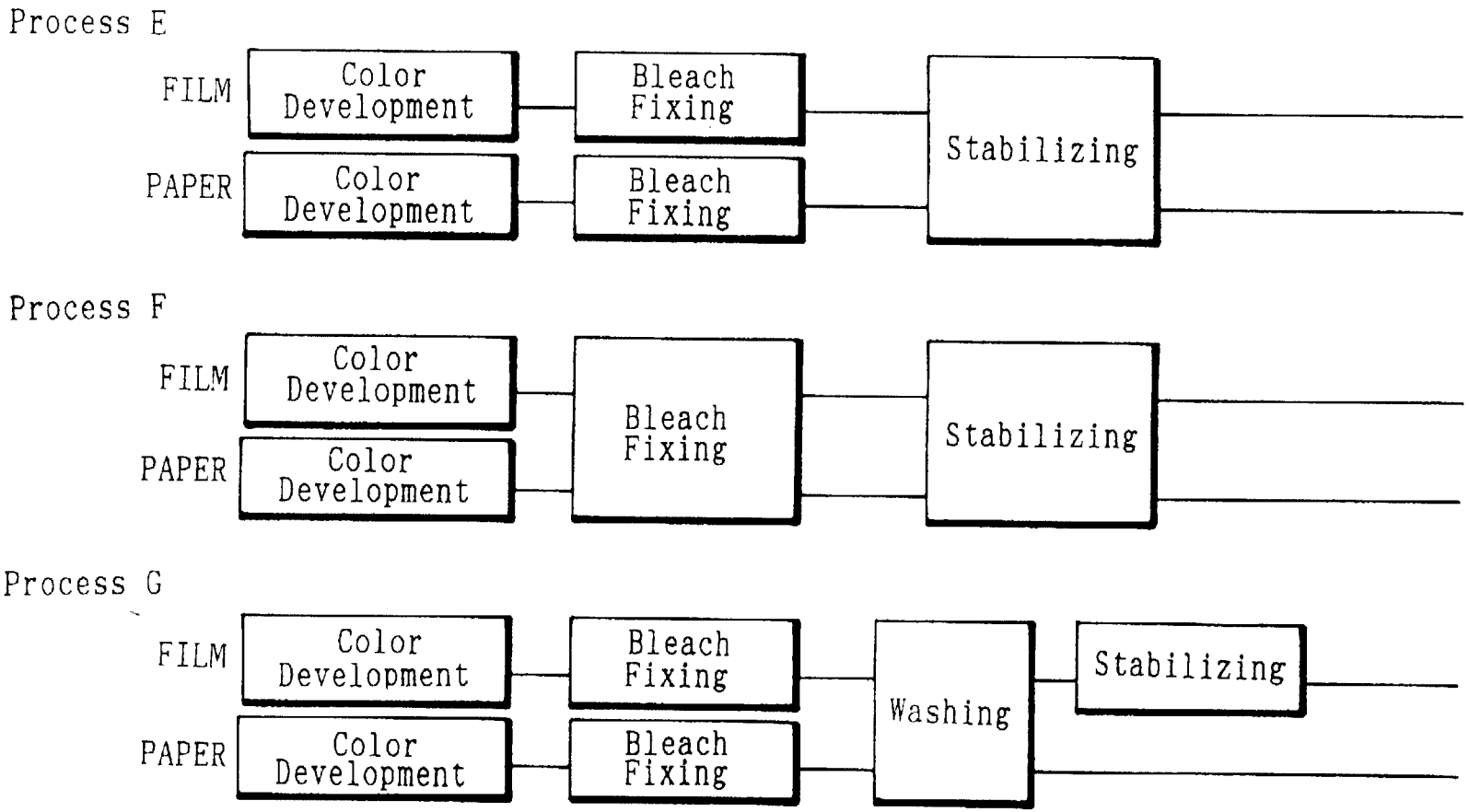

In the present invention, the film is processed by a color negative film processing and the paper is processed by a color paper processing. The two processing systems exist in a single casing. In this case, processing liquids for the color negative film processing and the color paper processing may be commonly used for the both processings. However, it is preferred that the color developing solution for the color negative film and the color developing solution for the color paper are separately used. Processing solutions at the downstream of the desilverization step may commonly be used for the color film processing and the color paper processing. Representative processing steps are shown in FIG. 5, but the present invention is not limited to these processing steps, and each processing bath may be a cascade system including two or more tanks, as occasion demands.

Detailed descriptions will be made on the processing solutions used in the present invention.

The color developer (developing solution) used in the processing apparatus of the present invention contains a known aromatic primary amine as the color developing agent. Preferred examples of the aromatic primary amines are p-phenylenediamine derivatives. Typical examples thereof include N,N-diethyl-p-phenylenediamine, 2-amino-5-diethylaminotoluene, 2-amino-5-(N-ethyl-N-laurylamino) toluene, 3-methyl-4-[N-ethyl-N-(β-hydroxyethyl)amino] aniline, 3-methyl-4-[N-ethyl-N-(δ-hydroxybutyl)amino] aniline, 2-methyl-4-[N-ethyl-N-(β-hydroxyethyl)amino] aniline, 4-amino-3-methyl-N-ethyl-N-[β-(methanesulfonamido)ethyl]-aniline, N-(2-amino-5-diethylaminophenylethyl)methanesulfonamide, N,N-dimethyl-p-phenylenediamine, 4-amino-3-methyl-N-ethyl-N-methoxyethylaniline, 4-amino-3-methyl-N-ethyl-N-β-ethoxyethylaniline and 4-amino-3-methyl-N-ethyl-N-β-butoxyethylaniline. Particularly preferred is 4-amino-3-methyl-N-ethyl-N-[β-(methanesulfonamido)ethyl]-aniline, 2-methyl-4-[N-ethyl-N-(β-hydroxyethyl)amino]aniline or 2-methyl-4-[N-ethyl-N-(δ-hydroxybutyl)amino]aniline.

Among the above-listed compounds, 4-amino-3-methyl-N-ethyl-N-[β-(methanesulfonamido)ethyl]-aniline and 3-methyl-4-[N-ethyl-N-(β-hydroxyethyl)amino]aniline are preferred for obtaining excellent photographic characteristics.

Such p-phenylenediamine derivatives may be in the form of their salts such as sulfate, hydrochloride, sulfite or p-toluenesulfonate. The aromatic primary amine developing agent must be used in an amount of at least about 0.10 mol/l, and it is preferably 0.12 to 0.50 mol/l, per liter of the color developer. In order to reduce the amount of the replenisher as far as possible and therefore to reduce the amount of the waste liquid, the color developer replenisher having a high concentration is preferably be used and the amount thereof is preferably about 0.17 to 1.00 mol, more preferably about 0.2 to 0.8 mol, per liter of the replenisher.

In order to reduce the size of a replenisher tank and a waste tank, and the size of the processing apparatus, the amount of the color developer-replenisher is preferably as small as possible. Concretely, in processing color negative films having a high silver content in its coating, the amount of the replenisher is about 50 to 600 ml/m$^2$, preferably about 100 to 400 ml/m$^2$. In processing color papers, the amount of the replenisher is about 20 to 70 ml/m$^2$, preferably about 30 to 60 ml/m$^2$ of the photosensitive material.

The amount of the waste liquid which varies depending on the amount of processing solutions carried over with the photosensitive material and the amount of the evaporation is usually about 0 to 400 ml/m$^2$ in processing the color negative films and about 0 to 20 ml/m$^2$ in processing the color papers.

In order to compensate a shortening of developing time and make up a reduction in the activity of the developer caused by the reduction in amount of the replenisher, the temperature in the processing with the color developer is preferably relatively high. In particular, the processing temperature is in the range of 39° C. to 55° C., most preferably 40° C. to 45° C. in both cases.

The color developer used in the present invention can contain hydroxylamine or a sulfite ion as an antioxidant and it preferably contains also an organic preservative.

The term "organic preservative" herein indicates any of organic compounds capable of reducing the deterioration velocity of the aromatic primary amine color developing agent when it is added to a processing solution for the color photosensitive material. Namely, they are organic compounds having a function of preventing the oxidation of the color developing agent by air or the like. Among them, examples of particularly effective organic preservatives include hydroxylamine derivatives, hydroxamic acids, hydrazines, hydrazides, phenols, α-hydroxyketones, α-aminoketones, saccharides, monoamines, diamines, polyamines, quaternary ammonium salts, nitroxy radicals, alcohols, oximes, diamide compounds and amines having a condensed ring. Particularly preferred are alkanolamines such as triethanolamine, dialkylhydroxylamines such as N,N-diethylhylhydroxylamine and N,N-di(sulfoethyl) hydroxylamine, hydrazine derivatives (except for hydrazine itself) such as N,N-bis(carboxymethyl)hydrazine, and aromatic polyhydroxy compounds such as sodium catechol-3, 5-disulfonate. It is preferred that the developing solutions for both of the color negative film processing and the color paper processing do not contain hydroxylamine.

An antifoggant can be added, if necessary, to the color developer used in the present invention. The antifoggants usable herein include alkali metal halides such as sodium chloride, potassium bromide and potassium iodide and organic antifoggants. The organic antifoggants are typified by nitrogen-containing heterocyclic compounds such as benzotriazole, 6-nitrobenzimidazole, 5-nitroisoindazole, 5-methylbenzotriazole, 5-nitrobenzotriazole, 5-chlorobenzotriazole, 2-thiazolylbenzimidazole, 2-thiazolylmethyl-benzimidazole, indazole, hydroxyazaindolizine and adenine.

The color developer used in the present invention has a preferred pH range of about 9.5 to 11.0. Provided that the developing activity can be kept, the pH of the developing solution in the tank is preferably as low as possible from the viewpoint of the stability of the developing solution. The most preferred pH of the tank solution is about 9.9 to 10.5.

A buffer is preferably used for keeping the pH in the above-described range. The buffers usable herein include, for example, carbonates, phosphates, borates, tetraborates, hydroxybenzoates, glycyl salts, N,N-dimethylglycine salts, leucine salts, norleucine salts, guanine salts, 3,4-dihydroxyphenylalanine salts, alanine salts, aminobutyric acid salts, 2-amino-2-methyl-1,3-propanediol salts, valine salts, proline salts, trishydroxyaminomethane salts and lysine salts. Particularly preferred are the carbonates and phosphates.

The amount of the buffer to be added to the developer is preferably at least 0.1 mol/l, particularly 0.1 to 0.4 mol/l.

A chelating agent can be added to the developer for inhibiting the prevention of precipitation of calcium and magnesium or for improving the stability of the color developer. The chelating agents include, for example, nitrilotriacetic acid, diethylenetriaminepentaacetic acid, ethylenediaminetetraacetic acid, N,N,N-trimethylenephosphonic acid, ethylenediamine-N,N,N',N'-tetramethylenephosphonic acid, transcyclohexanediaminetetraacetic acid, 1,2-diaminopropanetetraacetic acid, glycol ether diaminetetraacetic acid, ethylenediamine-o-hydroxyphenylacetic acid, 2-phosphonobutane-1,2,4-tricarboxylic acid, 1-hydroxyethylidene-1,1-diphosphonic acid, N,N'-bis(2-hydroxybenzyl) ethylenediamine-N,N'-diacetic acid and hydroxyethyliminodiacetic acid. These chelating agents may be used in combination of two or more of them, if necessary.

The chelating agent is added in an amount sufficient for sequestering metal ions in the developer. It is, for example, about 0.1 to 10 g per liter of the developer.

The developer used in the present invention can contain, if necessary, a development accelerator. The development accelerators include thioether compounds mentioned in Japanese Patent Publication (hereinafter referred to as "JP-B") Nos. 37-16088, 37-5987, 38-7826, 44-12380 and 45-9019 and U.S. Pat. No. 3,813,247; p-phenylenediamine compounds mentioned in Japanese Patent Application Laid-Open (hereinafter referred to as "JP-A") Nos. 52-9829 and 50-15554, quaternary ammonium salts mentioned in JP-A No. 50-137726, JP-B No. 44-30074, and JP-A Nos. 56-156826 and 52-43429; amine compounds mentioned in U.S. Pat. Nos. 2,494,903, 3,128,182, 4,230,796 and 3,253,919, JP-B No. 41-11431, U.S. Pat. Nos. 2,482,546, 2,596,926 and 3,582,346; polyalkylene oxides mentioned in JP-B Nos. 37-16088 and 42-25201, U.S. Pat. No. 3,128,183, JP-B Nos. 41-11431 and 42-23883 and U.S. Pat. No. 3,532,501; as well as 1-phenyl-3-pyrazolidones and imidazoles.

The color developer usable in the present invention preferably contains a fluorescent brightening agent, which is preferably a 4,4'-diamino-2,2'-disulfostilbene compound. It is used in an amount of 0 g/l to 5 g/l, preferably 0.1 g/l to 4 g/l.

The color developing time for the color negative film which is not particularly limited is usually about 15 seconds to 2 minutes and 30 seconds, preferably 30 seconds to 2 minutes and 30 seconds. The color processing time for the color paper is usually about 5 seconds to 35 seconds, preferably 10 seconds to 30 seconds.

In the processing machine of the present invention, the development step is followed by a desilverization process. An example of the desilverization steps of the present invention is as follows, which by no means limits the invention:

(step 1) bleaching/fixing,
(step 2) bleach-fixing,
(step 3) bleaching/bleach-fixing,
(step 4) bleaching/bleach-fixing/fixing,
(step 5) fixing/bleach-fixing, and Each of the bleaching, bleach/fixing and fixing may be conducted in a cascade system in two or more separated baths, if necessary, or the tank solution and the replenisher for processing the color negative films may be in common with those for processing the color papers.

Various bleaching agents are usable for preparing the bleaching solution and bleach-fixing solution to be used in the processing machine of the present invention. They include, for example, hydrogen peroxide, persulfates, potassium ferricyanide, dichromates, iron chlorides and ferric aminopolycarboxylates. Particularly preferred bleaching agents are the ferric aminopolycarboxylates.

Particularly preferred aminopolycarboxylic acids include EDTA, 1, 3-PDTA, diethylenetriaminepentaacetic acid, 1,2-cyclohexane diaminetetraacetic acid, iminodiacetic acid, methyliminodiacetic acid, N-(2-acetamido)iminodiacetic acid, nitrilotriacetic acid, N-(2-carboxyethyl)iminodiacetic acid, N-(2-carboxymethyl)iminodipropionic acid, β-alaninediacetic acid, ethylenediamine-N,N'-disuccinic acid, 1,3-propylenediamine-N,N'-disuccinic acid, compounds of general formula (I) given in JP-A No. 5-303186 and compounds of general formula (B) given in JP-A No. 5-188553. However, the aminopolycarboxylic acids are not particularly limited to them.

The concentration of the ferric complex salt in the bleach-fixing solution of the present invention is in the range of 0.005 to 2.0 mol/l, preferably 0.01 to 1.00 mol/l, and more preferably 0.02 to 0.50 mol/l.

The concentration of the ferric complex salt in the replenisher is preferably 0.005 to 2 mol/l, and more preferably 0.01 to 1.5 mol/l.

Various compounds can be incorporated, as a bleach-accelerating agent, into the bleaching solution, bleach-fixing solution and/or solution in the preceding bath thereof. Those having a high bleaching power include, for example, compounds having a mercapto group or disulfido bond as described in U.S. Pat. No. 3,893,858, German Patent No. 1,290,812, JP-A No. 53-95630 and Research Disclosure No. 17129 (July, 1978), and thiourea compounds described in JP-B No. 45-8506, JP-A Nos. 52-20832 and 53-32735 and U.S. Pat. No. 3,706,561, and halides containing iodine or bromine ion.

The bleaching solution and bleach-fixing solution usable in the present invention can contain a rehalogenating agent such as a bromide (e. g. potassium bromide, sodium bromide or ammonium bromide), a chloride (e. g. potassium chloride, sodium chloride or ammonium chloride) or an iodide (e. g. ammonium iodide). If necessary, the solution can contain one or more inorganic acids and organic acids having a pH-buffering function such as borax, sodium metaborate, acetic acid, sodium acetate, sodium carbonate, potassium carbonate, phosphorous acid, phosphoric acid, sodium phosphate, citric acid, sodium citrate and tartaric acid as well as alkali metal and ammonium salts of them, and a corrosion inhibitor such as ammonium nitrate or guanidine.

The bleaching solution and bleach-fixing solution can further contain a fluorescent brightener, defoaming agent, surfactant and organic solvent such as polyvinylpyrrolidone or methanol.

The fixing agents usable for the bleach-fixing solution or fixing solution are those known in the art. In particular, they are water-soluble silver halide-solubilizers including thiosulfates such as sodium thiosulfate and ammonium thiosulfate; thiocyanates such as sodium thiocyanate and ammonium thiocyanate; thioether compounds such as ethylenebisthioglycolic acid and 3,6-dithia-1,8-octanediol; and thioureas. They are usable either singly or in the form of a mixture of two or more of them. Further, a special bleach-fixing solution such as a combination of a fixing agent and a large amount of a halide, e. g. potassium iodide, as described in JP-A No. 55-155354 is also usable. In the present invention, a thiosulfate, particularly ammonium thiosulfate, is preferably used. If necessary, sodium thiosulfate is usable in combination with this compound. The amount of the fixing agent is in the range of preferably 0.3 mol/l to 2 mol/l, more preferably 0.5 mol/l to 1.0 mol/l, of the solution.

The bleach-fixing solution and the fixing solution preferably contain a preservative selected from among sulfite ion-releasing compounds, for example, sulfites such as sodiumsulfite, potassium sulfite and ammonium sulfite, bisulfites such as ammonium bisulfite, sodium bisulfite and potassium bisulfite and metabisulfites such as sodium metabisulfite, potassium metabisulfite and ammonium metabisulfite. The amount of such a compound contained in the solution is preferably about 0.02 mol/l to 0.05 mol/l, more preferably 0.04 mol/l to 0.40 mol/l, in terms of sulfite ion.

Although the sulfite is usually added as the preservative to the bleach-fixing solution or fixing solution, other compounds such as ascorbic acid, carbonyl bisulfite adducts and carbonyl compounds are also usable. Benzenesulfinic acids are also effective. If necessary, the bleach-fixing solution and fixing solution can contain a buffering agent, a fluorescent brightener, a chelating agent, an anti-foaming agent, mildew-proofing agent and so on.

The pH of the bleaching solution or bleach-fixing solution used in the present invention is preferably 2 to 8, more preferably 3 to 6.5.

In particular, the most preferred range of the pH of the bleach-fixing solution for color paper processing is 4.5 to 5.5. When the pH value is lower than this range, sinking of a processing solution from the edges of the support is apt to arise. When the pH value is higher than this range, streaks at the trailing end of the paper is apt to arise. The pH range of the fixing solution is preferably 4 to 8.

In the present invention, in order to reduce the size of a waste solution tank, the amount of the replenishing solution for each of the bleaching solution, the bleach-fixing solution and the fixing solution is preferably as small as possible. In more detail, the amount of replenishing solution for a color negative film is about 50 ml/m$^2$ to 400 ml/m$^2$ of photosensitive material, more preferably, about 100 ml/m$^2$ to 300 ml/m$^2$. The amount of replenishing solution for color paper processing is about 10 ml/m$^2$ to 100 ml/m$^2$ more preferably, about 10 ml/m$^2$ to 50 ml/m$^2$ of the photosensitive material.

The processing temperature in the desilverization process is about 35° C. to 50° C., preferably 38° C. to 45° C.

The processing time in the desilverization process is about 30 seconds to 2 minutes and 30 seconds, preferably about 40 seconds to 2 minutes for the color negative film, and about 10 seconds to 40 seconds, preferably 15 seconds to 30 seconds for the color paper.

The processing solution which can be used in the present invention has a bleaching function and the aeration of the processing solution is preferably carried out during processing to maintain an excellent stability of photographic characteristics of processed photosensitive materials. Any of aeration means known to person in the art can be utilized. When air is blown into the processing solution, it is preferred that the air is released into the solution through an air diffusion pipe having fine pores. Such air diffusion pipe are widely used in an aeration tank in the field of activated sludge processing. The aeration described in "Z-121, Using Process C-41, on pages BL-1 to BL-2, (Third Edition, 1982)" can be utilized.

The processing solution having bleaching function according to the present invention is preferably vigorously agitated, and the agitation can be implemented, without any modification, in accordance with the description from line 6 of the upper right column to line 2 of the lower left column on page 8 of JP-A No. 3-33847.

In the desilverization process, it is preferred that agitation is as strong as possible. In order to enhance agitation, there are various methods in which a jet of processing solution is made to impinge on the surface of an emulsion layer of a photosensitive material as described in JP-A No. 62-138460, an agitation effect is enhanced by the use of a rotation means as described in JP-A 62-183461, an emulsion surface of a photosensitive material is contacted with a wiper blade disposed in the processing solution while the photosensitive material is conveyed so that the processing solution on the surface of the emulsion layer is disturbed and the agitation is enhanced, and the circulating flow rate of the processing solution is increased. The above described methods for enhancing agitation are effective in the bleaching solution, the bleach-fixing solution and the fixing solution. The agitation of the processing solution is enhanced by expediting supply of a bleaching agent or a fixing agent into the emulsion layer so that the desilverization speed is increased. The above-described agitation enhancing means is more effective than a bleach accelerating agent and, the desilverization accelerating effect is further enhanced and a fix inhibiting action due to the bleach accelerator can be eliminated.

The processing solution having a bleaching function according to the present invention can be recycled in such a manner that an overflow solution is recovered after the processing solution is used for processing and the composition of the overflow solution is corrected by adding components. Such usage of the processing solution is generally referred to as regeneration and the regeneration can preferably be used in the present invention. The description on pages 39 to 40 of "Fuji Photo Film Processing Manual for Fujicolor Negative Film CN-16 Processing published by Fuji Photo Film Co. Ltd. (Revised in August, 1990) can be applicable to the regeneration in more detail.

A kit for preparing the processing solution having bleaching function according to the present invention may be either liquid form or powder form. When an ammonium salt is not contained in the kit, the powder form can easily be prepared since most of raw materials can be available in powder forms which have less moisture absorption characteristics. The above described kit for regeneration is preferably in the powder form since the components of the kit can be added without extra water from the view point of reducing the quantity of waste liquid.

The regeneration of the processing solution having bleaching function can be carried out in accordance with the above-described aeration as well as the methods disclosed in "Fundamentals of Photographic Engineering—Silver Salt Photography", edited by Photographic Society of Japan, and published by Corona Publishing Company in 1979. The regeneration methods include an electrolytic regeneration, and the regeneration of bleaching solutions with bromic acid, chlorous acid, bromine, bromine precursor, persulfate and hydrogen peroxide, as well as the regeneration of bleaching solutions with hydrogen peroxide, bromous acid and ozone by utilizing catalyzers.

In the electrolytic regeneration, an anode and a cathode are disposed in a single bleaching bath, or an anode bath and a cathode bath are separated by a separating membrane to regenerate the bleaching solution. Further, by the use of a separating membrane, the bleaching solution and the developing solution and/or the fixing solution can be regenerated at the same time. The regeneration of the fixing solution and the bleach-fixing solution can be performed by electrolytic reduction of accumulated silver ions. Further, accumulated halide ions preferably removed so as to maintain fixing characteristics.

The photosensitive materials according to the present invention can be develop-processed in a conventional manner in accordance with the above-described Research Disclosure No. 17643 on pages 28 to 29, No. 18716 from the left column to the right column on page 651, and No. 307105, on Pages 880 to 881.

In the processing machine of the present invention, the desilverization by fixing or bleach-fixing is usually followed by washing with water and/or stabilization.

The amount of the replenisher in the step of washing with water and the stabilization step is not limited. It is usually about 50 ml to 5 l per square meter of the photosensitive material. In order to attain the object of the present invention, the amount of the replenisher is desirably as small as about 1.0 to 20 parts per part of the solution carried-over from the preceding bath. Since the amount of the solution carried over from the preceding bath is usually about 50 ml per square meter of the photosensitive material, the actual amount of the replenisher is about 50 ml to 1,000 ml. It is more preferably about 2 to 10 parts per part of the solution carried over from the preceding bath.

The replenisher may be fed either continuously or intermittently. The solution used in the washing step and/or stabilization step may be used also in the preceding steps. For example, an overflow of the washing water or the stabilizing solution reduced in amount by a multi-stage countercurrent system is introduced in the preceding fixing bath or the bleach-fixing bath, and a concentrated solution is fed into the fixing bath or the bleach-fixing bath to reduced the amount of the waste liquid. This is one of preferred embodiments of the present invention.

The amount of water used in the washing step or the amount of the stabilizing solution in the stabilization step can be set in various ranges depending on the properties (variable depending on the substances used such as a coupler, etc.) of the photosensitive material, use of the material, solution temperature, number of the tanks (number of stages), replenishing method (countercurrent or following current) and other conditions. Usually 2 to 6 stages, particularly 2 to 4 stages, are preferred in the multi-stage countercurrent system.

The washing water and the stabilizing solution in the present invention can effectively be used by the use of water in a reduced amount of calcium and magnesium for inhibiting the propagation of bacteria as described in JP-A No. 62-288838.

The washing water can contain a surfactant as a water-repellent agent or a chelating agent typified by EDTA as a softening agent for hard water.

The photosensitive material can be processed with a stabilizing solution after the step of washing with water or without this step. The stabilizing solution contains a compound capable of stabilizing the image such as an aldehyde compound, e. g. formalin, or aldehyde-releasing compound. The compounds include N-methylolpyrazoles such as hexamethylenetetramine; N-methylolazoles described in JP-A No. 3-318644; and azolyl-methylamines such as N,N'-bis (1,2,4-triazol-1-yl)piperazine described in JP-A No. 4-313753. The stabilizing solution may contain a buffering agent for controlling the photosensitive layer to a pH suitable for stabilizing the dye, and an ammonium compound. If necessary, the stabilizing solution may contain a germicide and a mildew-proofing agent for inhibiting the propagation of bacteria in the solution or for imparting the mildew-proofing properties to the processed photosensitive material.

Further, the stabilizing solution may contain a surfactant, a fluorescent brightener and a hardening agent. When the stabilization is directly conducted without the preceding step of washing with water in processing the photosensitive material in the present invention, any of known methods described in JP-A Nos. 57-8543, 58-14834, 60-220345 and so on can be employed.

In a preferred embodiment, a chelating agent such as 1-hydroxyethylidene-1,1-diphosphonic acid or ethylenediamine tetramethylenephosphonic acid, or a magnesium compound or a bismuth compound is also used.

In the steps of washing with water and stabilization, the pH is preferably 4 to 10, more preferably 5 to 8. The temperature which varies depending on the use and properties of the photosensitive material is usually 15° to 45° C., preferably 20° to 40° C. Although the time is not particularly limited, the shorter, the better for obtaining the excellent effect of the invention. It is preferably 15 seconds to 1 minute 45 seconds, more preferably 15 seconds to 1 minute.

The processing composition usable in the present invention can be supplied in various forms. The processing agent can be supplied in the form of one concentrated solution or two or more parts of concentrated solutions; or a powder. It can be in such a form that it is directly usable without necessitating any process. Further, the processing agent can be a combination of the concentrated solution, powder and the directly usable solution.

The description will be made on the photosensitive material usable in the present invention.

Any kind of the photosensitive materials can be used in the present invention. Among the photosensitive materials, color negative films and color papers are preferred.

The silver halide emulsions, other materials such as additives, the photographic layer structure such as layer configuration, methods for processing the photosensitive materials, and additives used for the processing according to the present invention are preferably those described in the following patents, particularly European Patent No. 0,355,660 A2 (JP-A No. 1-107011).

TABLE 1

| Photographic constituent, etc. | JP-A 62-215272 |
|---|---|
| Silver halide emulsion | pp. 10, upper right column, line 6 to pp. 12, lower left column, line 5; and pp. 12, lower right column, |

TABLE 1-continued

| Photographic constituent, etc. | JP-A 62-215272 |
|---|---|
| | line 4 from the bottom to pp. 13 upper left column, line 17. |
| Solvent for silver halide | pp. 12, lower left column, lines 6 to 14; and pp. 13, upper left column, line 3 from the bottom to pp. 18, lower left column, the last line. |
| Chemical sensitizer | pp. 12, lower left column, line 3 to right lower column, line 5 from the bottom; and pp. 18 right lower column, line 1 to pp. 22 upper right column, line 9 from the bottom. |
| Spectral sensitizer (Spectral sensitizing method) | pp. 22, upper right column, line 8 from the bottom to pp. 38, the last line. |
| Emulsion stabilizer | pp. 39, upper left column, line 3 to pp. 72 upper right column, the last line. |
| Development accelerator | pp. 72, lower left column, line 1 to pp. 91, upper right column, line 3. |
| Color dye-forming coupler (cyan, magenta, and yellow dye-forming couplers) | pp. 91, right upper column, line 4 to pp. 121 upper left column, line 6. |
| Accelerator for color forming | pp. 121, lower left column, line 7 to pp. 121, upper right column, line 1. |
| Ultraviolet absorber | pp. 125, upper right column, line 2 to pp. 127, lower left column, the last line. |
| Dye-fading inhibitor (image stabilizer) | pp. 127, right lower column, line 1 to pp. 137, lower left column, the last line. |
| High boiling point and/or low boiling point organic solvent | pp. 137, lower left column, line 9 to pp. 144, right lower column, the last line. |
| Dispersion method for photographic additive | pp. 144, lower left column, line 1 to pp. 146, upper right column, line 7. |
| Hardener | pp. 146, upper right column, line 8 to pp. 155, lower left column, line 4. |
| Developing agent precursor | pp. 155, lower left column, line 5 to pp. 155 right lower column, line 2. |
| Development inhibitor releasing compound | pp. 155 right lower column, lines 3 to 9. |
| Support | pp. 155 right lower column, line 19 to pp. 156 upper left column, line 14. |
| Layer structure of photosensitive material | pp. 156, upper left column, line 15 to pp. 156, right lower column, line 14. |
| Dye | pp. 156, right lower column, line 15 to pp. 184 right lower column, the last line. |
| Color mixing inhibitor | pp. 185, upper left column, line 1 to pp. 188, right lower column, line 3. |
| Gradation controlling agent | pp. 188, lower right column, lines 4 to 8. |
| Anti-stain agent | pp. 188, lower right column, line 9 to pp. 193, lower right column, line 10. |
| Surfactant | pp. 201, lower right column, line 1 to pp. 210, upper right column, the last line. |
| Fluorine-containing compound (as anti-static agent, coating aid, lubricant, adhesion inhibitor, etc.) | pp. 201, lower left column, line 1 to pp. 222, lower left column, line 5. |
| Binder (hydrophillic colloid) | pp. 222, lower left column, line 6 to pp. 225, upper left column, the last line. |
| Thickening agent | pp. 225, upper right column, line 1 to pp. 227, upper right column, line 2. |
| Ant-static agent | pp. 227, upper right column, line 3 to pp. 230, upper left column, line 1. |
| Polymer latex | pp. 230, upper left column, line 2 to pp. 239, the last line. |
| Matting agent | pp. 240, upper left column, line 1 to pp. 240 upper right column, the last line. |
| Photographic processing method (processing method, additive, etc.) | pp. 3, upper right column, line 7 to pp. 10, upper right column, line 5. |

TABLE 2

| Photographic constituent, etc. | JP-A 2-33144 |
|---|---|
| Silver halide emulsion | pp. 28, upper right column, line 16 to pp. 29, lower right column, line 11; and pp. 30, lines 2 to 5 |
| Chemical sensitizer | pp. 29, lower right column, lines 3 to 13. |
| Spectral sensitizer (Spectral sensitizing method) | pp. 30, upper left column, lines 1 to 13. |
| Emulsion stabilizer | pp. 30, upper left column, line 14 to upper right column, line 1, |
| Color dye-forming coupler (cyan, magenta and yellow dye-forming couplers) | pp. 3, upper right column, line 14 to pp. 18, upper left column, the last line; and pp. 30, right upper column, line 6 to pp. 35, lower right column, line 11. |
| Ultraviolet ray absorber | pp. 37, lower right column, line 14 to pp. 38, upper left column, line 11. |
| Dye-fading inhibitor (image stabilizer) | pp. 36, upper right column, line 12 to pp. 37, upper left column, 19. |
| High boiling point and/or low boiling point organic solvents | pp. 35, lower right column, line 14 to pp. 36, upper left column, line 4 from the bottom; |
| Dispersion method of photographic additive | pp. 27, lower right column, line 10 to pp. 28, upper left column, the last line; and pp. 35, right lower column, line 12 to pp. 36, upper right column, line 7. |
| Support | pp. 36, upper right column, line 18 to pp. 39, upper left column, line 3. |
| Layer structure of photosensitive material | pp. 28, upper right column, lines 1 to 15. |
| Dye | pp. 38, upper left column, line |

TABLE 2-continued

| Photographic constituent, etc. | JP-A 2-33144 |
|---|---|
| | 12 to upper right column, line 7. |
| Color mixing inhibitor | pp. 36, upper right column, lines 8 to 11. |
| Anti-stain agent | pp. 37, upper lower left column, the last line to lower right column, line 13. |
| Surfactant | pp. 18, upper right column, line 1 to pp. 24, lower right column, the last line; and pp. 27, left lower column, line 10 from the bottom to lower right column, line 9. |
| Fluorine-containing compound (as anti-static agent, coating aid, lubricant, adhesion inhibitor, etc.) | pp. 25, upper left column, line 1 to pp. 27, upper right column, line 9. |
| Binder (hydrophillic colloid) | pp. 38, upper right column, lines 8 to 18. |
| Photographic processing method (processing method, additive, etc.) | pp. 39, upper left column, line 4 to pp. 42, upper left column, the last line. |

TABLE 3

| Photographic constituent, etc. | EP0,355,660A2 |
|---|---|
| Silver halide emulsion | pp. 45; line 53 to pp. 47, line 3; and pp. 47, lines 20 to 22. |
| Chemical sensitizer | pp. 47, lines 4 to 9. |
| Spectral sensitizer (Spectral sensitizing method) | pp. 47, lines 10 to 15. |
| Emulsion stabilizer | pp. 47, lines 16 to 19. |
| Color dye-forming coupler (cyan, magenta and yellow dye-forming couplers) | pp. 4, lines 15 to 27; pp. 5, line 30 to pp. 28, the last line; pp. 45, lines 29 to 31; and pp. 47, line 23 to pp. 63, line 50. |
| Ultraviolet ray absorber | pp. 65, lines 22 to 31. |
| Dye-fading inhibitor (image stabilizer) | pp. 4, line 30 to pp. 5 line 23; pp. 29, line 1 to pp. 45, line 25; pp. 45, lines 33 to 40; and pp. 65, lines 2 to 21. |
| High boiling point and/or low boiling point organic solvents | pp. 64, lines 1 to 51. |
| Dispersion method of photographic additive | pp. 63, line 51 to pp. 64, line 56. |
| Support | pp. 66, line 29 to pp. 67, line 13. |
| Layer structure of photosensitive material | pp. 45, lines 41 to 52. |
| Dye | pp. 66, lines 18 to 22. |
| Color mixing inhibitor | pp. 64, line 57 to pp. 65, line 1. |
| Anti-stain agent | pp. 65, line 32 to pp. 66, line 17. |
| Binder (hydrophilic colloid) | pp. 66, lines 23 to 28. |
| Photographic processing method (processing method, additive, etc.) | pp. 67, line 14 to pp. 69, line 28. |

Remarks:

1. The contents amended according the Amendments of March 16, 1987 are included in the cited items of JP-A 62-215272.
2. Of the above color dye-forming couplers, so-called short wave type yellow dye-forming couplers described in JP-A 63-231451, JP-A 63-123047, JP-A 63-241547, JP-A 1-173499, JP-A 213468 and JP-A 250944.

Various silver halide emulsions such as silver bromoiodide, silver chloroiodide, silver chlorobromoiodide, silver chlorobromide, silver bromide and silver chloride emulsions can be used in the present invention. The color negative film preferably has a layer containing a silver bromoiodide emulsion desirably having an iodine content of about 0.1 to 10 molar %. The color paper preferably has at least one emulsion layer containing silver halide grains comprising at least 90 molar % of silver chloride. The emulsion layer contains an emulsion comprising more preferably 95 to 99.9 molar % of silver chloride. All emulsion layers contain most preferably silver chlorobromide comprising 98 to 99.9 molar % of silver chloride. Although the coating amount of silver is not particularly limited, it is preferably about 2 to 10 g/m$^2$ for the color negative film, and about 0.2 to 0.9 g/m$^2$ for the color paper.

The color negative film which can be used in the present invention has preferably a magnetic recording layer as described above. The magnetic recording layer can be provided on a support either at the side thereof on which the silver halide emulsion is coated or at the other side of the support opposite to the emulsion layer. The latter is a preferred embodiment for reading magnetic records.

The magnetic recording layer is described hereinafter.

The magnetic recording layer which can be used in the present invention is made by coating an aqueous coating solution or a coating solution containing an organic solvent in which magnetic particles are dispersed in a binder.

The magnetic particles used in the present invention includes ferromagnetic ferric oxide such as $\gamma Fe_2O_3$, Co deposited $\gamma Fe_2O_3$, Co deposited magnetite, magnetite containing Co, ferromagnetic chromium dioxide, ferromagnetic metal, ferromagnetic alloy, hexagonal system Ba ferrite, Sr ferrite, Pb ferrite, Ca ferrite and the like. In particular, Co deposited ferromagnetic iron oxide such as Co deposited $\gamma Fe_2O_3$ and the like is preferred. The magnetic particle in the form of a needle, a rice grain, a ball, a cubic, a plate shape and the like can be used. The specific surface area of the particle is preferably more than 20 m$^2$/g, more preferably more than 30 m$^2$/g in SBET. The saturation magnetization ($\delta s$) of the ferromagnetic body is preferably 3.0×104 to 3.0×105 A/m, more preferably 4.0×104 to 2.5×105 A/m. The ferromagnetic particle may be surface-treated with silica and/or alumina, or an organic material. Further, the surface of the magnetic particles may be treated with a silane coupling agent or a titan coupling agent as described in JP-A No. 6-161032. The magnetic particle covered with an inorganic material or an organic material can also be used as described in JP-A No. 4-259911 and JP-A No. 5-81652.

As a binder used for dispersing the magnetic particles, thermoplastic resins, thermosetting resins, radiation hardening resins, reactive resins, acid-degradable polymers, alkalidegradable polymers, bio-degradable polymers, natural polymers such as cellulose derivatives, saccharide derivatives and the like, and the mixture thereof can be used. Tg of these resins is –40° C. to 300° C., and the weight-average molecular weight of these resins is 2,000 to 1,000,000. These resins and polymers include vinyl copolymers, cellulose derivatives such as cellulose diacetate, cellulose triacetate, cellulose acetate propionate, cellulose acetate butyrate, cellulose tripropyonate, acrylate resins and polyvinyl acetal resins. Gelatin can also preferably be used. In particular, cellulose diacetate and cellulose triacetate are preferred. The binders can be cured by adding cross-linking agents such as an epoxy type, an aziridine type and an isocyanate type. The cross-linking agents of the isocyanate type include tolylene diisocyanate, 4,4'-diphenylmethane diisocyanate, hexamethylene diisocyanate and xylylene diisocyanate, reaction products between the isocyanates and polyalcohols such as the reaction product between 3 mole of tolylene diisocyanate and 1 mole of trimethylol propane, and polyisocyanates formed by condensation of these isocyanates as described in JP-A No. 6-59357.

The aforementioned magnetic particles are dispersed in the binder by use of a kneader, a pin type mill, an annular type mill and the like, as described in JP-A No. 35092. Two or more of these devices can be used. Dispersants described in JP-A No. 5-88283 and other known dispersants can be used. The thickness of the magnetic recording layer is 0.1 μm to 10μ, preferably 0.2 μm to 5 μm, more preferably 0.3 μm to 3 μm. The weight ratio of the magnetic particles to the binder is preferably 0.5:100 to 60:100, more preferably 1:100 to 30:100. The coating amount of the magnetic particles are in the range of 0.005 to 3 g/m$^2$, preferably in the range of 0.01 to 2 g/m$^2$, more preferably 0.02 to 0.5 g/m$^2$. The transmission density of yellow color of the magnetic recording layer is preferably in the range of 0.01 to 0.5, more preferably 0.03 to 0.2, and most preferably 0.04 to 0.15. The magnetic recording layer can be provided on the back surface of a support of a photographic material over the entire surface or in a stripe form by means of coating or printing. The magnetic recording layer are coated on the support by various coating methods such as an air doctor coating, a blade coating, an air knife coating, a squeezing coating, an immersion coating, a reverse roller coating, a transfer roller coating, a gravure coating, a kiss roll coating, a cast coating a spray coating, a dip coating, a bar coating, an extrusion coating and the like. A coating solution disclosed in JP-A No. 5-341436 can preferably used.

The magnetic recording layer can have functions such as improved lubrication, curling behavior control, electrostatic charge prevention, adhesion prevention, magnetic head grinding and the like. Alternatively, another layer having these functions may be provided. A grinding agent in which at least one type of particles is non-spherical inorganic particles having a hardness of 5 in Mohs scale. The non-spherical inorganic particles are preferably fine powder of oxides such as aluminum oxide, chromium oxide, silicon dioxide, titanium dioxide, and the like, carbides such as silicon carbide, titanium carbide and diamond and the like. The surface of these griding agents may be treated with a silane coupling agent or a titanium coupling agent. These particles may be added to the magnetic recording layer or an overcoating layer (such as a protective layer and a lubricating layer) on the magnetic recording layer. The aforementioned binders can be used in the overcoating layer, and the same binder as that of the magnetic recording layer is preferred. Photosensitive materials having the magnetic recording layer are disclosed in U.S. Pat. Nos. 5,336,589, 5,250,404, 5,229,259, 5215,874 and EP No. 466,130.

The film support which can be used in the present invention will be described hereinafter.

In the present invention, the supports such as PET (polyethylenetelephthalate), TAC (triacetylcellulose) and the like which are commonly used as well as other types of supports, can be used. However, in order to fully exert the effects of the present invention, polyester supports (PEN) are preferred. The polyester supports are described in detail, but details including photosensitive materials, processings, cartridges and embodiments are described in Kokai Giho (Laid-Open Technical Report) No. 94-6023 (Published by Hatsumei Kyokai (Japan Invention Association) on Mar. 15, 1994).

The polyesters which can be used in the present invention are formed with diols and aromatic dicarboxylic acids as essential components. The aromatic dicarboxylic acids are 2,6-naphthalenedicarboxylic acid, 1,5-naphthalenedicarboxylic acid, 1,4-naphthalenedicarboxylic acid, 2,7-naphthalenedicarboxylic acid, telephthalic acid, isophthalic acid and phthalic acid. The diols are diethyleneglycol, triethyleneglycol, cyclohexanedimethanol, bisphenol A and bisphenol. The polymers are homopolymers such as polyethylenetelephtalate, polyethylenenaphtahalate, polycyclohexanedimethanol telephthalate and the like. Preferred polymers are a polyseter containing 50 mole % to 100 mole % of 2,6-naphthalenedicarboxylic acid. The most preferred polymer is polyethylene 2,6-naphthalate. Average molecular weight is approximately in the range of 5,000 to 200,000. The Tg value of the polyesters which can be used in the present invention is more than 50° C., preferably more than 90° C.

The polyester support is preferably treated with heat at a temperature between 40° C. and Tg, more preferably at a temperature between Tg-20° C. and Tg so as to prevent a trained curl behavior of the support (APEN). A heat treatment can be performed at a temperature in the above temperature range or during cooling the support. The period of time for the heat treatment is 0.1 to 1,500 hours, preferably 0.5 to 200 hours. The support may be treated with heat in a rolled state of the support, or, in a web state during conveying the support. The surface of the support may be roughened, for instance, by applying electroconductive inorganic fine particles such as $SnO_2$, $Sb_2O_5$, etc. on the surface of the support to improve the surface characteristics. It is preferred that the edges of the support in the transverse direction are knurled to be higher than the other portion of the support so that transfer of the edge shape in the core portion of the roll of the support is prevented. The heat treatment can be carried out at any step after the support is made to be layered, the surface of the support is treated, a back layer containing an electrostatic charge preventing agent, a lubricating agent and the like is coated on the back surface of the support, and a subbing layer is coated. However, the heat treatment after coating of the electrostatic charge preventing agent is the most preferred step.

An ultraviolet ray absorbing agent may be incorporated into the polyester. Further, in order to prevent light piping, commercially available dyes or pigments for polyester use such as Diaresin manufactured by Mitsubishi Kasei, Kayaset manufactured by Nippon Kayaku, etc., may be incorporated into the polyester.

In the present invention, the surface of the support is treated to adhere the photosensitive layers onto the support. The treatment includes the surface activating treatment such as a chemical treatment, a mechanical treatment, a corona discharge treatment, a flame treatment, an ultraviolet ray irradiating treatment, a high-frequency treatment, a glow discharge treatment, an active plasma treatment, a laser treatment, a mixed acid treatment, an ozone oxidation treatment and the like. The ultraviolet ray irradiating treatment, the flame treatment, the corona discharge treatment and the glow treatment are preferred surface treatments.

The subbing layer may be either a single layer or two layer or more. Binders for the subbing layer include copolymers made from monomers selected from the group of vinyl chloride, vinylidene chloride, butadiene, methacrylic acid, acrylic acid, itaconic acid, maleic acid anhydride as starting materials, as well as polyethyleneimine, epoxy resins, grafted gelatin, nitrocellulose and gelatin. Compounds for swelling the support include resorcin and p-chloro-phenol. Gelatin hardeners for the subbing layer are chromates such as chrome alum, etc., aldehydes such as formaldehyde, glutaraldehyde, etc., isocyanates, active halogen compounds such as 2,4-dichloro-6-hydroxy-S-triazine, etc., epichlorhydrine resin, active vinylsulfone compounds and the like. The subbing layer may contain $SiO_2$, $TiO_2$, inorganic fine particles or fine particles of polymethylmethacrylate copolymer (0.01 μm to 10 μm in diameter) as matting agents.

The color negative film which can be used in the present invention contains preferably an electrostatic charge preventing agent. The electrostatic charge preventing agents include carboxylic acids, salts of carboxylic acids, polymers containing sulfonic acid, cationic polymers and ionic surfactants. The electrostatic charge preventing agents can be at least one of crystalline metal oxides selected from the group of ZnO, $TiO_2$, $SnO_2$, $Al_2O_3$, $In_2O_3$, $SiO_2$, MgO BaO, $MoO_3$ and $V_2O_3$, which have a volume resistivity of less than 107 Ωcm, more preferably less than 105 Ωcm and particle diameter of 0.001 to 1.0 μm, or fine particles of composite oxides (Sb, O, In, S, Si, C, etc.) with these metal oxides. Further, the metal oxides in a sol state or fine particles of composite oxides thereof can be used. These metal oxides or the composite oxides can contain in the photosensitive material in the range of 5 to 500 mg/$m^2$, more preferably 10 to 350 mg/$m^2$. The ratio of the amount of the electroconductive crystalline oxides or composite oxides to the amount of the binder is 1/300 to 100/1, preferably 1/100 to 100/5.

The negative film which can be used in the present invention has preferably lubricating characteristics. The layers containing lubricants may be provided both on the side of the photosensitive layers and the back side of the film. As lubricating characteristics, the coefficient of dynamic friction is preferably in the range of 0.01 to 0.25. The coefficient of dynamic friction was measured when the film was relatively moved with respect to a stainless steel ball of 5 mm in diameter at a speed of 60 cm/min. at 25° C. and 60% relative humidity. In this test, when the photosensitive layer is used in place of the stainless steel ball, approximately the same value is obtained.

The lubricating agents which can be used in the present invention are polyorganosiloxanes, higher fatty acid amides, metal salts of higher fatty acids, esters of higher fatty acids and higher alcohols. The polyorganosiloxanes include polydimethylsiloxane, polydiethylsiloxane, polystyrylmethylsiloxane, polymethylphenylsiloxane, etc. The layer into which the lubricating agents can be added are preferably the outermost layer of the emulsion layers or the back layer. Polydimethylsiloxane and esters having long chain alkyl groups are particularly preferred.

It is preferable that the negative film which can be used in the present invention contains a matting agent. The matting agent can be contained in any layer of the emulsion side and the reverse side of the negative film. However, it is most preferable that the outermost layer of the emulsion side of the negative film. The matting agent can be either soluble or insoluble in the processing solution. However, it is preferable that both the soluble and insoluble matting agents are used together. As the matting agents, for example, particles of polymethylmethacrylate, poly(methylmethacrylate/methacrylic acid=9/1 or 5/5 (molar ratio)), polystylene and the like are preferred. The diameters of the particles are preferably in the range of 0.8 to 10 μm, and a narrower distribution of the diameters is preferred. More than 90% of the total number of particles are preferably in the range of 0.9 to 1.1 times of an average diameter of the particles. In order to enhance the matting function, it is preferred to add fine particles having a diameter of 0.8 μm or less in addition to the above-described particles. For example, polymethylmethacrylate particles having a diameter of 0.2 μm, poly (methylmethacrylate/methacrylic acid=9/1) having a diameter of 0.3 μm, polystylene particles having a diameter of 0.25 μm, colloidal silica having a diameter of 0.03 μm can be added together.

The photosensitive material used in the present invention can contain various couplers. The details are given in Tables 1, 2 and 3.

Preferred cyan dye-forming couplers include diphenylimidazole type cyan dye-forming couplers described in JP-A No. 2-33144, as well as 3-hydroxypyridine type cyan dye-forming couplers described in European Patent No. 0,333,185 A2 [particularly preferred are a cyan dye-forming coupler prepared by converting a four-equivalent coupler (42) into a two-equivalent one by introducing a chlorine-linked coupling-off group, and couplers (6) and (9) mentioned therein], and cyclic active methylene type cyan dye-forming couplers described in JP-A No. 64-32260 (particularly preferred are couplers 3, 8 and 34 mentioned therein).

It is preferred that a dye (particularly an oxonol dye) which can be decolored by a process as described on pages 27 through 76 of European Patent No. 0,337,490 A2 is incorporated into a hydrophilic colloid layer in such a manner that the optical reflection density of the photosensitive material is 0.70 or more at 680 nm in order to improve the sharpness of the image, or that at least 12% by weight (more desirably at least 14% by weight) of titanium oxide surface-treated with a dihydric to tetrahydric alcohol (such as trimethylolethane)is incorporated into a water-resistant resin layer of the support.

The color photographic photosensitive material used in the present invention can preferably contain a compound for improving the dye image stability as described in European Patent No. 0,277,589 A2 in addition to the coupler, particularly preferably a pyrazoloazole type dye-forming coupler.

To inhibit staining or other side effects caused by a dye formed by, for example, the reaction of the color developing agent or an oxidation product thereof remaining in a layer of the photosensitive material with the coupler during the storage after processing the photosensitive-material, it is preferred to use compound (F) which can be chemically bonded with an aromatic amine developing agent remaining after the color development to form a chemically inert, substantially colorless compound and/or compound (G) which can be chemically bonded with an oxidation product of the aromatic amine color developing agent remaining after the color development to form a chemically inert, substantially colorless compound. Either the compound (F) or (G) can be used solely or the compounds (F) and (G) can be used together.

A mildew-proofing agent as described in JP-A No. 63-271247 is preferably incorporated into the photosensitive material used in the present invention in order to prevent the propagation of fungi and bacteria which deteriorate the image in the hydrophilic colloid layer.

For reducing an amount of carry-over and also for increasing the rate of recovery of silver, it is desirable that film thickness in a dry state of the silver halide color photosensitive material used in the present invention excluding the thickness of the support is 25 μm or less. Particularly, the film thickness in a dry state of the color negative film is preferably about 13 μm to 23 μm, and that of the color paper is preferably about 7 μm to 12 μm.

The thickness of the film or the paper can be reduced by reducing the amount of the gelatin, silver, oil, coupler, etc. The reduction of the amount of gelatin is most preferred. The film thickness can be determined by an ordinary method after leaving the sample to stand at 25° C. at 60% RH for two weeks.

To improve a stain and an image stability, the degree of swelling of the photographic layers of the silver halide color photographic material used in the invention is preferably 1.5 to 4.0, particularly 1.5 to 3.0. The term "degree of swelling" herein indicates a value obtained by dividing the thickness of the photographic layers after immersing the color photosensitive material in distilled water of 33° C. for 2 minutes by the thickness of the dry photographic layers.

The term "photographic layers" indicate layers composed of at least one photosensitive silver halide emulsion layer laminated with hydrophilic colloid layers, the former layer and the latter layers being water-permeable between each other. The photographic layers do not include a back layer provided on the support on an opposite side to the photographic photosensitive layers. The photographic layers comprise usually two or more layers involved in the formation of a photographic image, namely, a silver halide emulsion layer, an intermediate layer, a filter layer, an antihalation layer and a protective layer.

The degree of swelling as described above can be controlled by any method. For example, it can be controlled by varying the amount and kind of the gelatin and those of the hardener used for the photographic layer or by varying the drying conditions and storing conditions after coating the photographic layers. Although gelatin is advantageously used for forming the photographic layers, other hydrophilic colloids can also be used. For example, various synthetic hydrophilic polymer substances can be used, such as gelatin derivatives; graft polymers of gelatin and another polymer; proteins such as albumin and casein; cellulose derivatives such as hydroxyethylcellulose, carboxymethylcellulose and cellulose sulfate; saccharide derivatives such as sodium alginate and starch derivatives; and homopolymers or copolymers such as polyvinyl alcohol, partial acetal of polyvinyl alcohol, poly-N-vinylpyrrolidone, polyacrylic acid, polymethacrylic acid, polyacrylamide, polyvinylimidazole and polyvinylpyrazole.

The gelatins usable herein include a lime-processed gelatin or an acid-processed gelatin, gelatin hydrolyzate and enzymatic decomposition products of the gelatin. The gelatin derivatives are obtained by reacting gelatin with a compound selected from among various acid halides, acid anhydrides, isocyanates, bromoacetic acid, alkanesultones, vinylsulfonamides, maleinimide compounds, polyalkylene oxides and epoxy compounds.

The graft polymers of gelatin usable herein include those obtained by grafting a homopolymer or copolymer of a vinyl monomer such as acrylic acid, methacrylic acid or a derivative thereof, e. g. an ester or amide thereof, acrylonitrile or styrene onto gelatin. Preferred are graft polymers of gelatin with a polymer which is compatible with gelatin to a considerable extent such as a polymer of acrylic acid, methacrylic acid, acrylamide, methacrylamide or hydroxyalkyl methacrylate. Examples of these graft polymers are given in U.S. Pat. Nos. 2,763,625, 2,831,767, 2,956,884 and etc. Typical synthetic hydrophilic polymer substances are described in, for example, West German Patent Application (OLS) No. 2,312,708, U.S. Pat. Nos. 3,620,751 and 3,879,205 and JP-B No. 43-7561.

The hardening agents include, for example, chromium salts such as chromium alum and chromium acetate, aldehydes such as formaldehyde, glyoxal and glutaraldehyde, N-methylol compounds such as dimethylolurea and methloldimethylhydantoin), dioxane derivatives such as 2,3-dihydroxydioxane, active vinyl compounds such as 1,3,5-triacryloyl-hexahydro-s-triazine, bis(vinylsulfonyl)methyl ether and N,N'-methylene-bis-[β-(vinylsulfonyl) propionamide], active halogen compounds such as 2,4-dichloro-6-hydroxy-s-triazine, mucohalogenic acids such as mucochloric acid and mucophenoxychloric acid, isoxazoles, dialdehyde starch and 2-chloro-6-hydroxytriazinylated gelatin. They can be used either singly or in combination thereof.

Particularly preferred hardening agents are the aldehydes, active vinyl compounds and active halogen compounds.

The paper support for the photosensitive material used in the present invention may be a white polyester support for display or a support having a white pigment-containing layer formed thereon on the same side as the silver halide emulsion layer. In order to enhance image sharpness, an antihalation layer is preferably provided on the same side as the silver halide emulsion layer on the support or on the back side of the support. The transmission density of the support is controlled preferably in the range of 0.35 to 0.8 so that the display can be seen with a reflected light or transmitted light.

The photosensitive material used in the present invention may be exposed to a visible light or an infrared light. The photosensitive material may be exposed by either a low illuminance and long-time exposure or a high illuminance and short-time exposure. In the latter, a laser scanning exposing method in which the exposure time per pixel is shorter than $10^{-4}$ second is preferred.

In the exposure, a band stop filter described in U.S. Pat. No. 4,880,726 is preferably used in order to remarkably improve the color reproducibility by avoiding the optical mixing.

The processing method used in the present invention can be employed for various photosensitive materials such as color negative films, color negative papers, color reversal papers, autopositive papers and color reversal films. Particularly preferred are color negative films and color negative papers.

The present invention will be described in detail by the following examples in which the processing apparatus according to the present invention, which by no means limit the invention.

EXAMPLE 1

(1) Materials for supports

Each of supports used in this Example was prepared by the following manner.

PEN: 100 weight parts of commercially available poly (ethylene-2,6-naththalate) polymer and 2 weight parts of Tinuvin P. 326 (manufactured by Geigy) as an ultra-violet ray absorbing agent were dried in a conventional manner and were molten at 300° C. The molten mixture was extruded from a T-type die and drawn to 3.3 times at 140° C. in the longitudinal direction, and thereafter drawn to 3.3 times at 130° C. in the transverse direction, and further thermally fixed for six second at 250° C. The glass-transition temperature thereof was 120° C.

TAC: Triacetylcellulose support was prepared on a band by a regular solution flow expanding method in which the concentration of triacetylcellulose in a solution containing methylenechloride and methanol at a weight ratio of 82/8, and 15 wt % of triphenyl phosphate (TPP) and biphenyldiphenyl phosphate (BDP) at a weight ratio of 2/1 as plasticizers was 13%.

A sample of the PEN (APEN) support which was thermally treated was denoted as Sample 101 and a sample of a PEN support which was not thermally treated was denoted as Sample 103. A sample of the TAC support was denoted as Sample 102.

(2) Coating of subbing layer

Both sides of each of the supports above were processed by a corona discharge method and a subbing layer was coated on the side which was exposed to a higher temperature during the extrusion, with a coating solution having a composition described below. The corona discharge process was carried out by 6 KVA Model of a solid state corona discharge processing apparatus manufactured by Pillar Corporation in such a manner that the supports of 30 cm in width were processed at a speed of 20 m/minute. The supports were processed at a condition of 0.375 KV·A·min./m$^2$. The discharge frequencies were 9.6 KHz and the clearance between an electrode and an induction roll was 1.6 mm.

| | |
|---|---|
| Gelatin | 3 g |
| Distilled water | 250 ml |
| Sodium-α-sulfo-di-2-ethylhexyl-succinate | 0.05 g |
| Formaldehyde | 0.02 g |

A subbing layer having the following composition was provided on a TAC support.

| | |
|---|---|
| Gelatin | 0.2 g |
| Salicylic acid | 0.1 g |
| Methanol | 15 ml |
| Acetone | 85 ml |
| Formaldehyde | 0.01 g |

(3) Coating of back layers

The back layers 1 to 3 having the following compositions were coated on the other side of each of the supports having respective subbing layers coated in accordance with the process (2) above.

| | |
|---|---|
| (a) First back layer | |
| Fine powder of needle form γ-ferric oxide containing Co (average particle diameter: 0.08 μm. Dispersed in gelatin) | 0.2 g/m$^2$ |
| Gelatin | 3 g/m$^2$ |
| Compound having Formula (1) | 0.1 g/m$^2$ |
| Compound having Formula (2) | 0.02 g/m$^2$ |
| Poly(ethylacrylate)having average particle diameter of 0.08 μm | 1 g/m$^2$ |

Formula (1)

$$(CH_2{=}CHSO_2NHCH_2CH_2NH)_2CO$$

-continued

Formula (2)

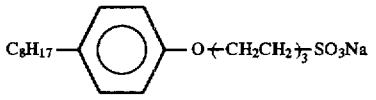

| | |
|---|---|
| (b) Second Back layer | |
| Gelatin | 0.05 g/m$^2$ |
| Electroconductive material ($SnO_2/Sb_2O_3$ (9:1); Average diameter: 0.15 μm) | 0.16 mg/m$^2$ |
| Sodium dodecylbenzenesulfonate | 0.05 g/m$^2$ |
| (c) Third back layer | |
| Gelatin | 0.5 g/m$^2$ |
| Polymethylmethacrylate (Average diameter: 1.5 μm) | 0.02 g/m$^2$ |
| Cetylstearate (Dispersed with sodium dodecylbenzenesulfonate) | 0.01 g/m$^2$ |
| Sodium (2-ethylhexyl)sulfosuccinate | 0.01 g/m$^2$ |
| Compound having Formula (3) | |

Formula (3)

$$C_8F_{17}SO_2N(C_3H_7)(CH_2CH_2O)_4(CH_2)_4SO_3Na$$

The antimagnetic power of the back layers thus obtained was 960 Oe.

(4) Heat treatment of support

Each of the supports on which the respective subbing layers and the respective back layers were coated in accordance with the above methods was dried and taken up, and thereafter, was treated with heat at 110° C. for 8 hours.

Photosensitive layers described in (5) below were coated on each of the two types of the supports described above to form photosensitive materials. The photosensitive material having the PEN support was denoted as Sample 101, and the photosensitive material having the TAC support was denoted as Sample 102. The photosensitive material having the PEN support without heat treatment was denoted as Sample 103.

(5) Preparation of photosensitive layers (Compositions of photosensitive layers)

Main materials used for forming the layers are classified as follows:

ExC: cyan dye-forming coupler

ExM: magenta dye-forming coupler

ExY: yellow dye-forming coupler

ExS: sensitizing dye

UV : ultraviolet absorber

HBS: high-boiling organic solvent

H : gelatin hardener

The numerals for the respective components indicate the amount of coating given by g/m$^2$. Those for silver halides are given in terms of silver. Those for sensitizing dyes are given in terms of molar unit per mol of the silver halide contained in the same layer.

(Sample 101)

The first layer (antihalation layer):

| | |
|---|---|
| Black colloidal silver emulsion | silver 0.09 |
| Gelatin | 1.60 |
| ExM-1 | 0.12 |
| ExF-1 | $2.0 \times 10^{-3}$ |
| Solid dispersed dye ExF-2 | 0.030 |

-continued

| | |
|---|---|
| Solid dispersed dye ExF-3 | 0.040 |
| HBS-1 | 0.15 |
| HBS-2 | 0.02 |

The second layer (intermediate layer):

| | |
|---|---|
| Silver bromoiodide emulsion M | silver 0.065 |
| ExC-2 | 0.04 |
| Polyethyl acrylate latex | 0.20 |
| Gelatin | 1.04 |

The third layer (low-speed red-sensitive emulsion layer)

| | |
|---|---|
| Silver bromoiodide emulsion A | silver 0.25 |
| Silver bromoiodide emulsion B | silver 0.25 |
| ExS-1 | $6.9 \times 10^{-5}$ |
| ExS-2 | $1.8 \times 10^{-5}$ |
| ExS-3 | $3.1 \times 10^{-4}$ |
| ExC-1 | 0.17 |
| ExC-3 | 0.030 |
| ExC-4 | 0.10 |
| ExC-5 | 0.020 |
| ExC-6 | 0.010 |
| Cpd-2 | 0.025 |
| HBS-1 | 0.10 |
| Gelatin | 0.87 |

The fourth layer (medium-speed red-sensitive emulsion layer)

| | |
|---|---|
| Silver bromoiodide emulsion C | silver 0.70 |
| ExS-1 | $3.5 \times 10^{-4}$ |
| ExS-2 | $1.6 \times 10^{-5}$ |
| ExS-3 | $5.1 \times 10^{-4}$ |
| ExC-1 | 0.13 |
| ExC-2 | 0.060 |
| ExC-3 | 0.0070 |
| ExC-4 | 0.090 |
| ExC-5 | 0.015 |
| ExC-6 | 0.0070 |
| Cpd-2 | 0.023 |
| HBS-1 | 0.10 |
| Gelatin | 0.75 |

The fifth layer (high-speed red-sensitive emulsion layer)

| | |
|---|---|
| Silver bromoiodide emulsion D | silver 1.40 |
| ExS-1 | $2.4 \times 10^{-4}$ |
| ExS-2 | $1.0 \times 10^{-4}$ |
| ExS-3 | $3.4 \times 10^{-4}$ |
| ExC-1 | 0.10 |
| ExC-3 | 0.045 |
| ExC-6 | 0.020 |
| ExC-7 | 0.010 |
| Cpd-2 | 0.050 |
| HBS-1 | 0.22 |
| HBS-2 | 0.050 |
| Gelatin | 1.10 |

The sixth layer (intermediate layer)

| | |
|---|---|
| Cpd-1 | 0.090 |
| Solid dispersed dye ExF-4 | 0.030 |
| HBS-1 | 0.050 |
| Polyethyl acrylate latex | 0.15 |
| Gelatin | 1.10 |

The seventh layer (low-speed green-sensitive emulsion layer)

| | |
|---|---|
| Silver bromoiodide emulsion E | silver 0.15 |
| Silver bromoiodide emulsion F | silver 0.10 |
| Silver bromoiodide emulsion G | silver 0.10 |
| ExS-4 | $3.0 \times 10^{-5}$ |
| ExS-5 | $2.1 \times 10^{-4}$ |
| ExS-6 | $8.0 \times 10^{-4}$ |
| ExM-2 | 0.33 |
| ExM-3 | 0.086 |
| ExY-1 | 0.015 |
| HBS-1 | 0.30 |
| HBS-3 | 0.010 |
| Gelatin | 0.73 |

The eighth layer (medium-speed green-sensitive emulsion layer)

| | |
|---|---|
| Silver bromoiodide emulsion H | silver 0.80 |
| ExS-4 | $3.2 \times 10^{-5}$ |
| ExS-5 | $2.2 \times 10^{-4}$ |
| ExS-6 | $8.4 \times 10^{-4}$ |
| ExC-8 | 0.010 |
| ExM-2 | 0.10 |
| ExM-3 | 0.025 |
| ExY-1 | 0.018 |
| ExY-4 | 0.010 |
| ExY-5 | 0.040 |
| HBS-1 | 0.13 |
| HBS-3 | $4.0 \times 10^{-3}$ |
| Gelatin | 0.80 |

The ninth layer (high-speed green-sensitive emulsion layer)

| | |
|---|---|
| Silver bromoiodide emulsion I | silver 1.25 |
| ExS-4 | $3.7 \times 10^{-5}$ |
| ExS-5 | $8.1 \times 10^{-5}$ |
| ExS-6 | $3.2 \times 10^{-4}$ |
| ExC-1 | 0.010 |
| ExM-1 | 0.020 |
| ExM-4 | 0.025 |
| ExM-5 | 0.040 |
| Cpd-3 | 0.040 |
| HBS-1 | 0.25 |
| Polyethyl acrylate latex | 0.15 |
| Gelatin | 1.33 |

The tenth layer (yellow filter layer)

| | |
|---|---|
| Yellow colloidal silver emulsion | silver 0.015 |
| Cpd-1 | 0.16 |
| Solid dispersed dye ExF-5 | 0.060 |
| Solid dispersed dye ExF-6 | 0.060 |
| Oil-soluble dye ExF-7 | 0.010 |
| HBS-1 | 0.60 |
| Gelatin | 0.60 |

The eleventh layer (low-speed blue-sensitive emulsion layer)

| | |
|---|---|
| Silver bromoiodide emulsion J | silver 0.09 |
| Silver bromoiodide emulsion K | silver 0.09 |
| ExS-7 | $8.6 \times 10^{-4}$ |
| ExC-8 | $7.0 \times 10^{-3}$ |
| ExY-1 | 0.050 |
| ExY-2 | 0.22 |
| ExY-3 | 0.50 |
| ExY-4 | 0.020 |

-continued

| | |
|---|---|
| Cpd-2 | 0.10 |
| Cpd-3 | $4.0 \times 10^{-3}$ |
| HBS-1 | 0.28 |
| Gelatin | 1.20 |

The twelfth layer (high-speed blue-sensitive emulsion layer)

| | |
|---|---|
| Silver bromoiodide emulsion L | silver 1.00 |
| ExS-7 | $4.0 \times 10^{-4}$ |
| ExY-2 | 0.10 |
| ExY-3 | 0.10 |
| ExY-4 | 0.010 |
| Cpd-2 | 0.10 |
| Cpd-3 | $1.0 \times 10^{-3}$ |
| HBS-1 | 0.070 |
| Gelatin | 0.70 |

The thirteenth layer (the first protective layer)

| | |
|---|---|
| UV-1 | 0.19 |
| UV-2 | 0.075 |
| UV-3 | 0.065 |
| HBS-1 | $5.0 \times 10^{-2}$ |
| HBS-4 | $5.0 \times 10^{-2}$ |
| Gelatin | 1.8 |

The fourteenth layer (the second protective layer)

| | |
|---|---|
| Silver bromoiodide emulsion M | silver 0.10 |
| H-1 | 0.40 |
| B-1 (diameter: 1.7 μm) | $5.0 \times 10^{-2}$ |
| B-2 (diameter: 1.7 μm) | 0.15 |
| B-3 | 0.05 |
| S-1 | 0.20 |
| Gelatin | 0.70 |

Further, the respective layers suitably contain W-1 to W-3, B-4 to B-6, F-1 to F-17, iron salts, lead salts, gold salts, platinum salts, iridium salts, palladium salts and rhodium salts in order to improve the storability, processing characteristics, pressure resistance, mildew-proofing and bacteria-proofing properties, antistatic properties and coating characteristics.

TABLE 4

| Emulsion | Average AgI content (%) | Coefficient of variation in AgI content among grains (%) | Average grain diameter (diameter of corresponding sphere) (μm) |
|---|---|---|---|
| A | 1.7 | 10 | 0.46 |
| B | 3.5 | 15 | 0.57 |
| C | 8.9 | 25 | 0.66 |
| D | 8.9 | 18 | 0.84 |
| E | 1.7 | 10 | 0.46 |
| F | 3.5 | 15 | 0.57 |
| G | 8.8 | 25 | 0.61 |
| H | 8.8 | 25 | 0.61 |
| I | 8.9 | 18 | 0.84 |
| J | 1.7 | 10 | 0.46 |
| K | 8.8 | 18 | 0.64 |
| L | 14.0 | 25 | 1.28 |
| M | 1.0 | — | 0.07 |

TABLE 4-continued

| Emulsion | Coefficient of variation of grain diameter (%) | Diameter of projected plan (diameter of corresponding circle) (μm) | Diameter/ thickness ratio |
|---|---|---|---|
| A | 15 | 0.56 | 5.5 |
| B | 20 | 0.78 | 4.0 |
| C | 25 | 0.87 | 5.8 |
| D | 26 | 1.03 | 3.7 |
| E | 15 | 0.56 | 5.5 |
| F | 20 | 0.78 | 4.0 |
| G | 23 | 0.77 | 4.4 |
| H | 23 | 0.77 | 4.4 |
| J | 26 | 1.03 | 3.7 |
| J | 15 | 0.50 | 4.2 |
| K | 23 | 0.85 | 5.2 |
| L | 26 | 1.46 | 3.5 |
| M | 15 | — | 1 |

In Table 4:

(1) The emulsions J to L were reduction-sensitized with thiourea dioxide and thiosulfonic acid in the step of preparation of the grains as described in an Example of JP-A No. 2-191938;

(2) The emulsions A to I were sensitized by gold sensitization, sulfur sensitization and selenium sensitizaiton methods in the presence of a spectral sensitizing dye mentioned above for each photosensitive layer and sodium thiocyanate as described in an Example of JP-A No. 3-237450;

(3) In the preparation of tabular grains, a low-molecular weight gelatin was used as described in an Example of JP-A No. 1-158426;

(4) Dislocation lines as described in JP-A No. 3-237450 were observed on the tabular grains with a high-voltage electron microscope; and (5) The emulsion L contained double-structure particles each having an internal high-iodine core as described in JP-A No. 60-143331.

Preparation of dispersion of organic solid disperse dye:

ExF-2 which will be described below was dispersed as follows:

21.7 ml of water, 3 ml of 5% aqueous solution of sodium p-octylphenoxyethoxyethanesulfonate and 0.5 g of 5% aqueous solution of p-octylphenoxy polyoxyethylene ether (degree of polymerization: 10) were fed into a 700 ml pot mill. 5.0 g of dye ExF-2 and 500 ml of zirconium oxide beads (diameter: 1 mm) were added thereto, and the mixture was milled with a BO type vibration ball mill (a product of Chuo Koki) for 2 hours to obtain a dispersion. The resulting dispersion was taken out and added to 8 g of 12.5% aqueous gelatin solution. The beads were removed by filtration to obtain a dispersion of the dye in gelatin. The average particle diameter of the fine dye particles was 0.44 μm.

A solid dispersion of each of ExF-3, ExF-4 and ExF-6 was obtained in the same manner as described above. The average particle diameters of the fine dye particles were 0.24 μm, 045 μm and 0.52 μm, respectively. ExF-5 was dispersed by a microprecipitation dispersion method described in Example 1 in European Patent Application (EP) No. 549,489 A. The average particle diameter was 0.06 μm.

ExC-1
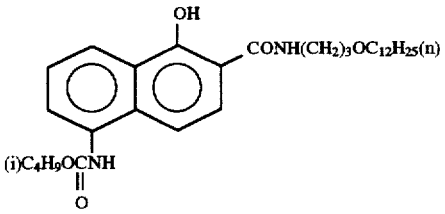
ExC-2
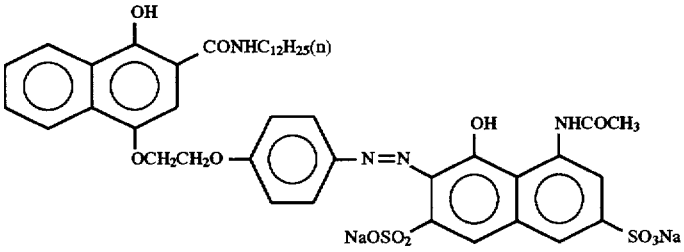
ExC-3
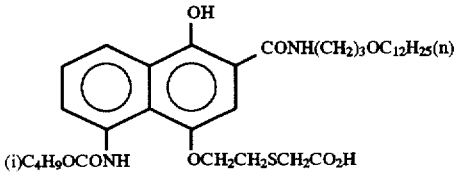
ExC-4
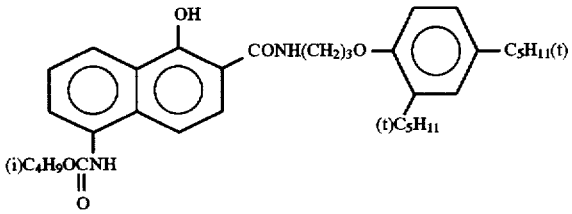
ExC-5
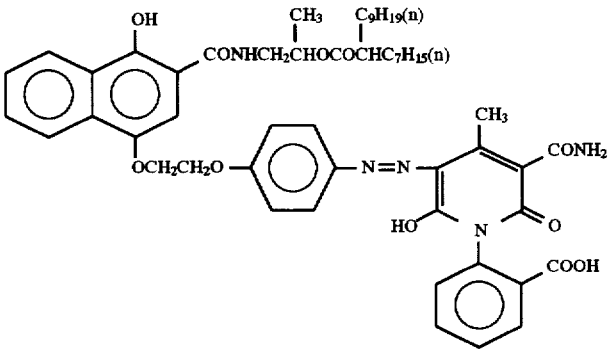
ExC-6
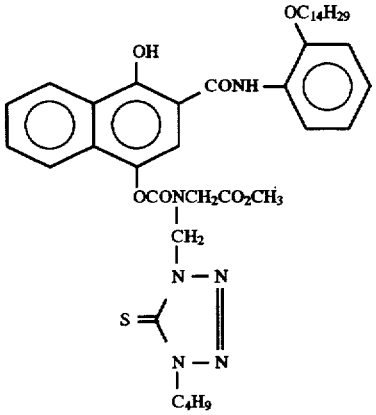

-continued
ExC-7
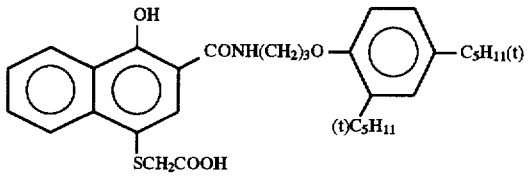
ExC-8
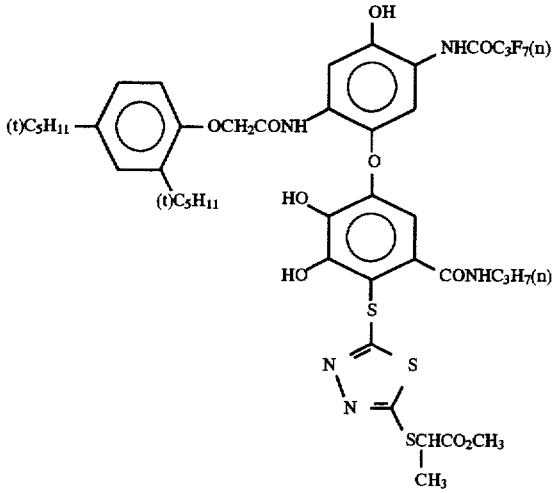
ExM-1
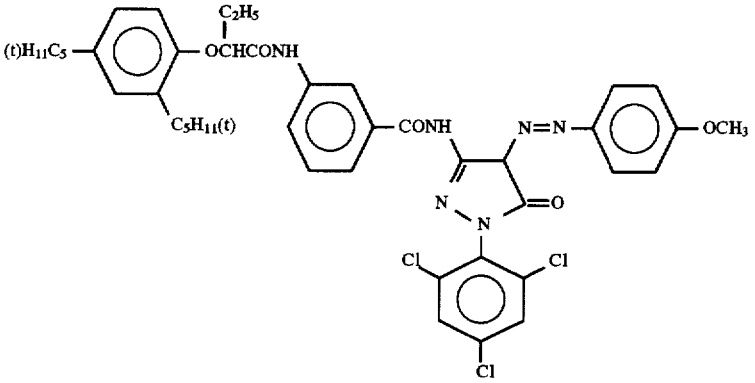
ExM-2
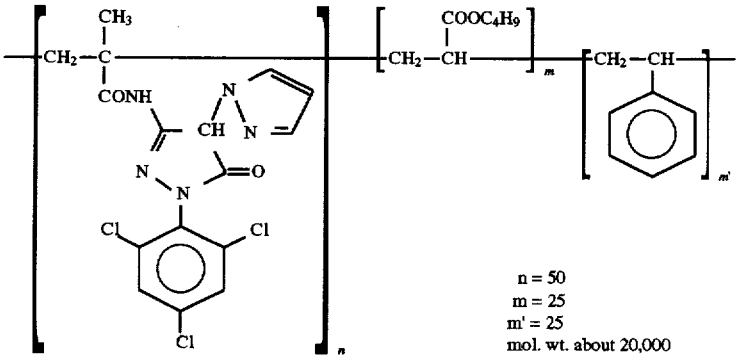
n = 50
m = 25
m' = 25
mol. wt. about 20,000

-continued
ExM-3
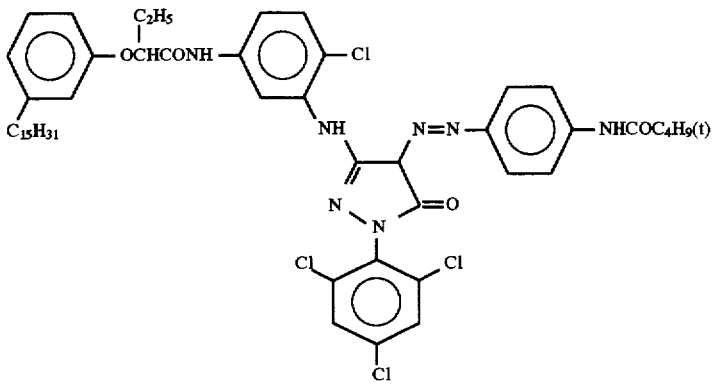
ExM-4
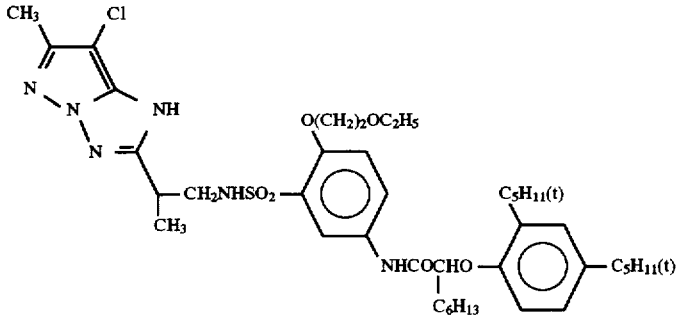
ExM-5
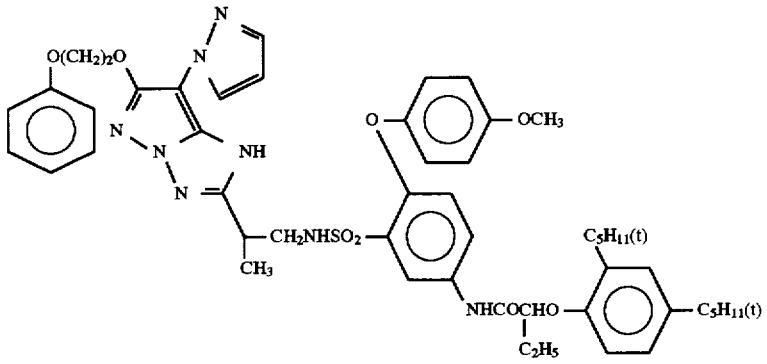
ExY-1
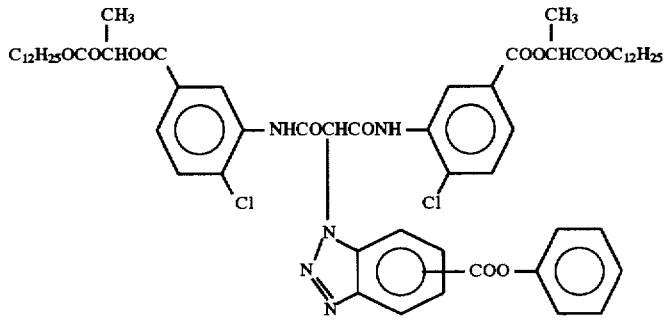

-continued
ExY-2
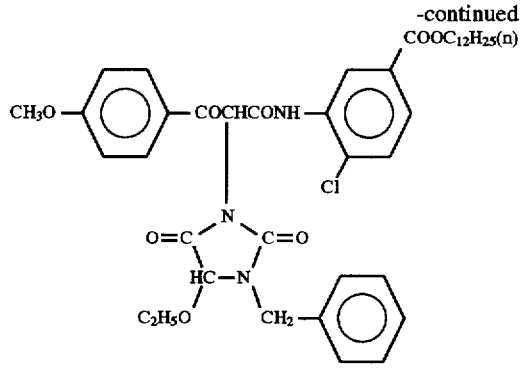
ExY-3
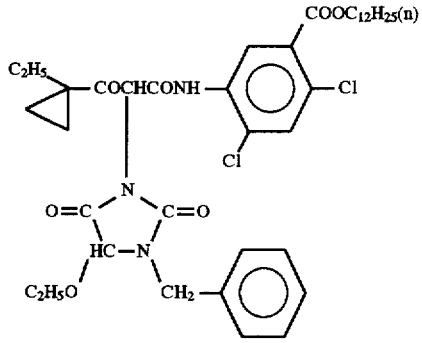
ExY-4
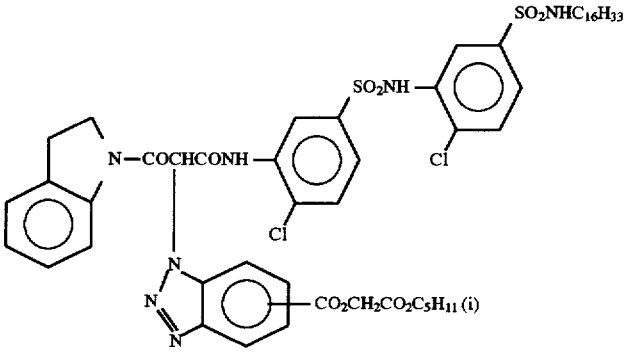
ExY-5
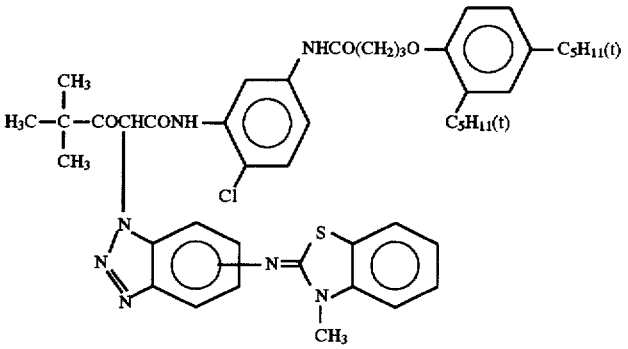
ExF-1
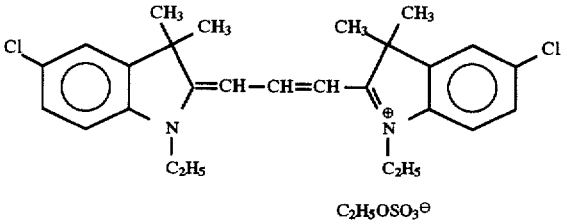

-continued
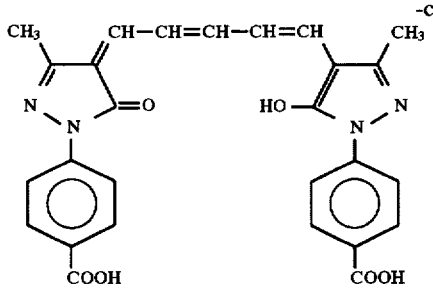
ExF-2
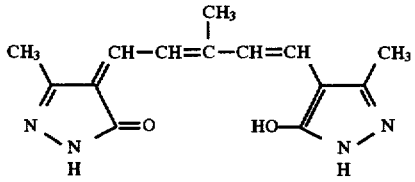
ExF-3
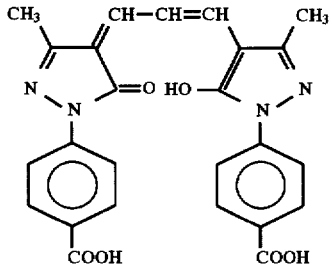
ExF-4
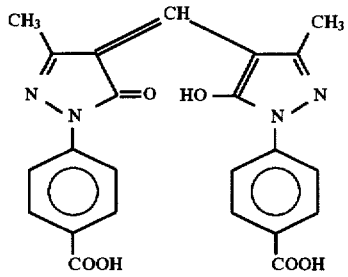
ExF-5
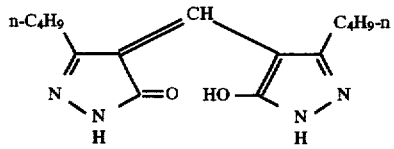
ExF-6
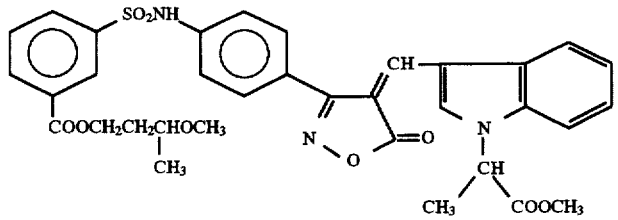
ExF-7
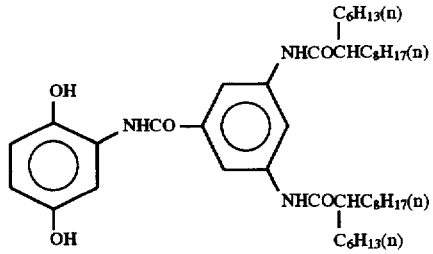
Cpd-1

-continued
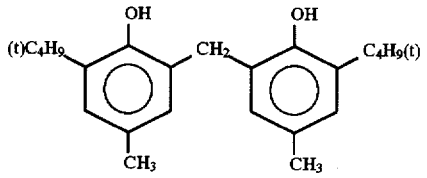
Cpd-2
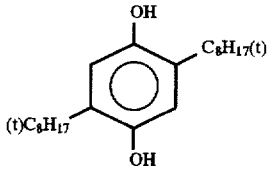
Cpd-3
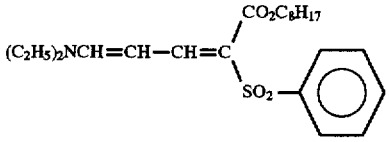
UV-1
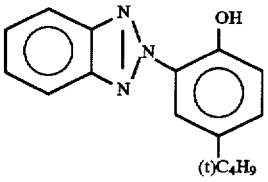
UV-2
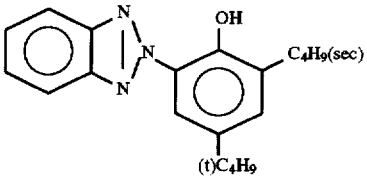
UV-3
tricresyl phosphate HBS-1
di-n-butyl phthalate HBS-2
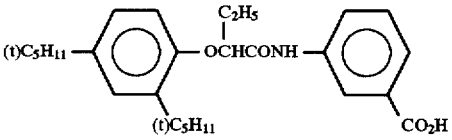
HBS-3
tri(2-ethylhexyl) phosphate HBS-4
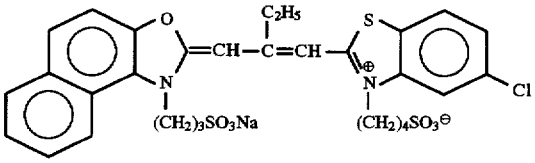
ExS-1
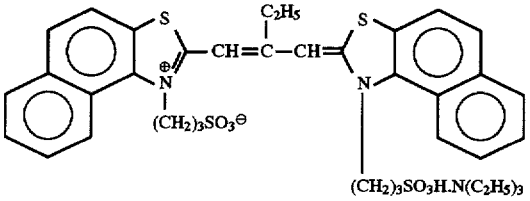
ExS-2

-continued
ExS-3
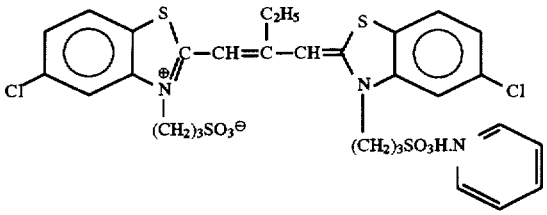
ExS-4
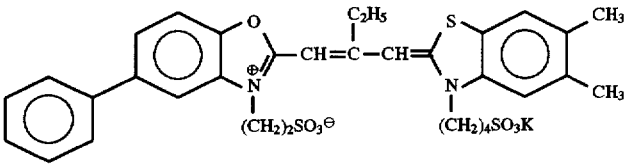
ExS-5
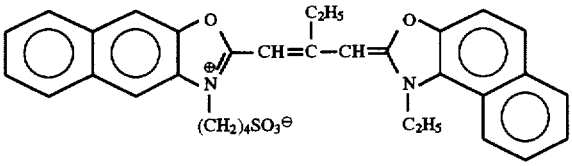
ExS-6
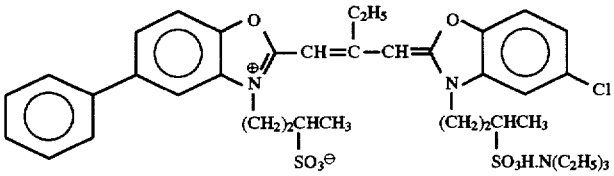
ExS-7
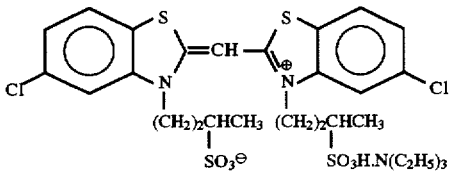
S-1
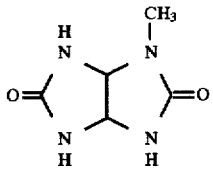
H-1
$CH_2{=}CH{-}SO_2{-}CH_2{-}CONH{-}CH_2$
$CH_2{=}CH{-}SO_2{-}CH_2{-}CONH{-}CH_2$
B-1
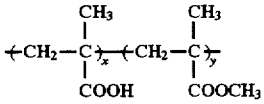
x/y = 10/90
B-2
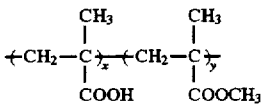
x/y = 40/60
B-3
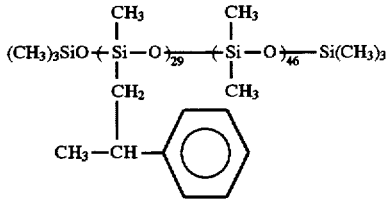

-continued
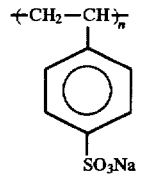
B-4
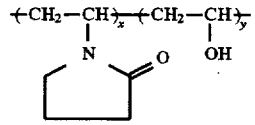
x/y = 70/30
B-5
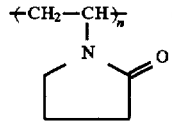
(mol. wt. approx. 10,000)
B-6
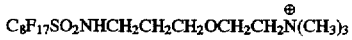
W-1
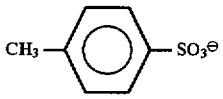
W-2
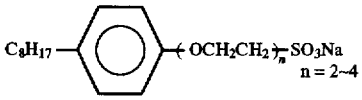
W-3
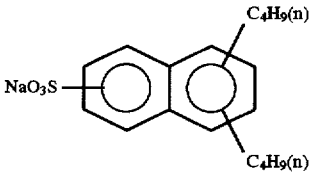
F-1
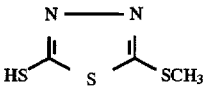
F-2
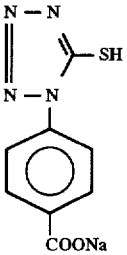
F-3
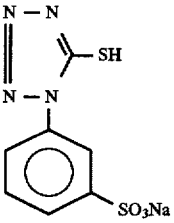
F-4
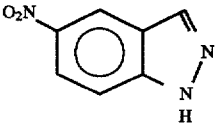

-continued
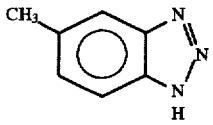
F-5
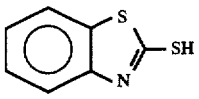
F-6
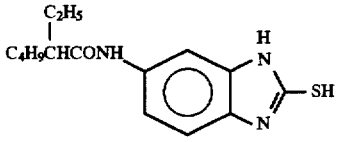
F-7
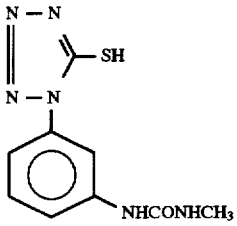
F-8
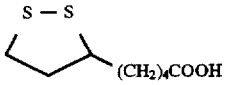
F-9
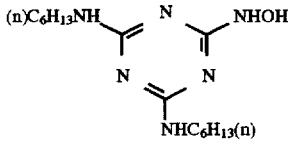
F-10
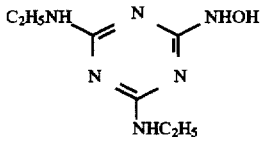
F-11
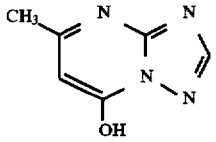
F-12
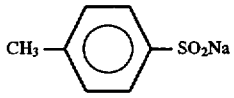
F-13
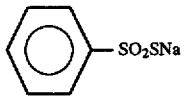
F-14
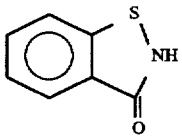
F-15
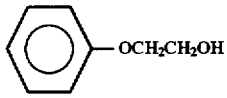
F-16

-continued

F-17

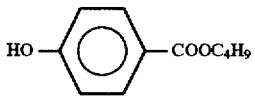

The photosensitive materials prepared as described above were cut into pieces of 24 mm in width and 160 cm in length. A pair of perforations of 2 millimeters square were provided at the positions of 0.7 mm from one edge of the photosensitive material, the perforations being apart from each other at a distance of 5.8 mm in the longitudinal direction of the photosensitive materials. The pair of the perforations were provided at a distance of 32 mm in the longitudinal direction of the photosensitive material. The photosensitive material thus prepared was accommodated in a plastic cartridge as described in FIGS. 1 to 7 of U.S. Pat. No. 5,296,887.

FM signals were recorded at a speed of 100 mm/second on the magnetic recording layer between the perforations of the photosensitive material from the side of the magnetic recording layer, by use of a head which is capable of inputting and outputting, with a head gap of 5 μm and a turn number of 2000/second.

A color print material was prepared in the following manner.

After the surface of a paper laminated on the both sides thereof with polyethylene was subjected to a corona discharge treatment, a subbing layer containing sodium dodecylbenzene sulfonate was provided thereon. Further, various layers constituting photographic layers were coated thereon to prepare a multilayer color photographic paper (201) having a layer structure shown below. The coating solutions were prepared in the following manner.

153.0 g of a yellow dye-forming coupler (ExY-11), 15.0 g of a dye image stabilizer (Cpd-11), 7.5 g of a dye image stabilizer (Cpd-12) and 16.0 g of a dye image stabilizer (Cpd-13) were dissolved in 25 g of a solvent (Solv-11), 25 g of a solvent (Solv-12) and 180 ml of ethylacetate. The resulting solution was emulsified and dispersed in 1,000 g of a 10% aqueous gelatin solution containing 60 ml containing 60 ml of 10% sodium dodecylbenzenesulfonate and 10g of citric acid, thereby an emulsified dispersion A was prepared. A silver chlorobromide emulsion A was prepared in which the silver chlorobromide emulsion A was a mixture of an emulsion A containing large size cubic grains having an average grain size of 0.88 μm and an emulsion A containing small size cubic grains having an average grain size of 0.70 μm at a silver molar ratio of 3:7. The fluctuation coefficients of grain size distribution of the emulsions were 0.08 and 0.10, respectively. Each emulsion contained locally 0.3 mole % of silver bromide on a part of the surface of grains consisting of silver chloride base grains. Blue sensitive spectral sensitizing dyes A and B shown below were added to each of the emulsion A containing large size grains and the emulsion containing small size grains in the amount of $2\times10^{-4}$ mole per mole of silver and in the amount of $2.5\times10^{-4}$ per mole of silver, respectively. The emulsions were chemically ripened by adding a sulfur sensitizer and a gold sensitizer. The above-described emulsified dispersion A and the silver chlorobromide emulsion A were mixed and molten to prepare a coating solution for the first layer having the following composition. The coating amount of the emulsion is represented in terms of a coating amount converted to a silver amount.

Coating solutions for the second to the seventh layers were prepared in the same manner as that in the coating solution for the first layer. As a gelatin hardener for each layer, sodium 1-oxy-3,5 dichloro-s-triazine was used. Cpd-24 and Cpd-25 were added to each layer so as to be 25.0 mg/m$^2$ and 50.0 mgm$^2$, respectively.

The following spectral sensitizing dyes were used for silver chlorobromide emulsions for the respective photosensitive emulsion layers:

Blue sensitive emulsion layer:

Sensitizing dye A

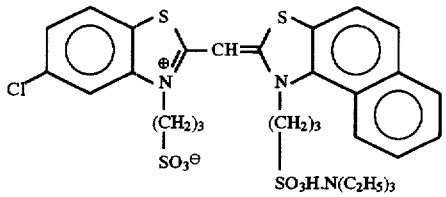

and

Sensitizing dye B

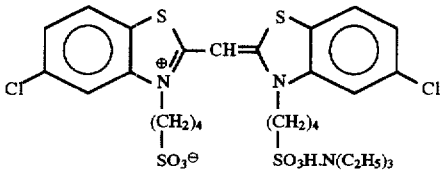

Each of the sensitizing dyes was added in the amount of $2.0\times10^{-4}$ mole per mole of silver halide in the emulsion containing large size grains, and in the amount of $2.5\times10^{-4}$ mole per mole of silver halide in the emulsion containing small size grains, respectively.

Green sensitive emulsion layer:

Sensitizing dye C

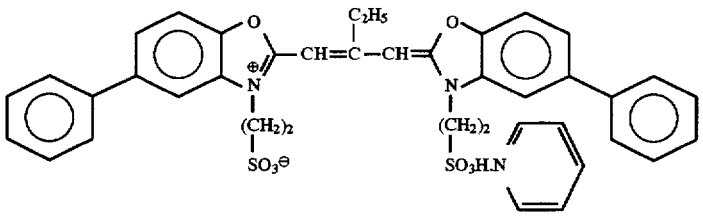

The sensitizing dye C was added in the amount of $4.0\times10^{-4}$ mole per mole of silver halide in the emulsion containing large size grains, and in the amount of $5.6\times10^{-4}$ mole per mole of silver halide in the emulsion containing small size grains, respectively.

Sensitizing dye D

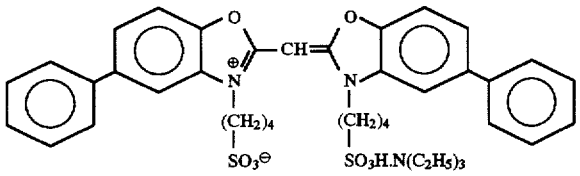

The sensitizing dye D was added in the amount of $7.0\times10^{-4}$ mole per mole of silver halide in the emulsion containing large size grains, and in the amount of $1.0\times10^{-4}$ mole per mole of silver halide in the emulsion containing small size grains, respectively.

Red sensitive emulsion layer:

Sensitizing dye E

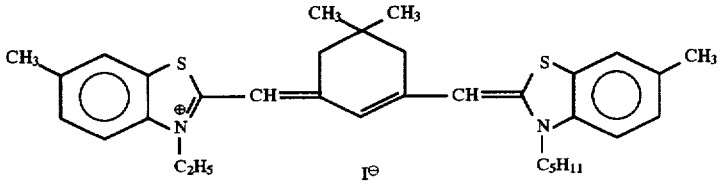

The sensitizing dye E was added in the amount of $0.9\times10^{-4}$ mole per mole of silver halide in the emulsion containing large size grains, and in the amount of $1.1\times10^{-4}$ mole per mole of silver halide in the emulsion containing small size grains, respectively.

Further, the following compound was added in the amount of $2.6\times10^{-3}$ mole per mole of silver halide.

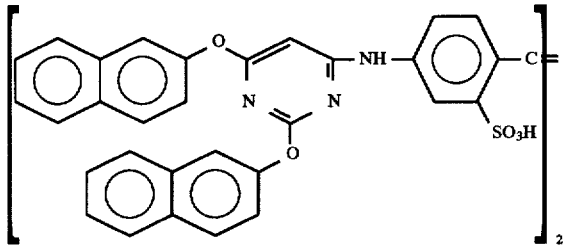

Furthermore, 1-(5-methylureidophenyl)-5-mercaptotetrazole was added to the blue sensitive emulsion layer, the green sensitive emulsion layer and the red sensitive emulsion layer in the amounts of $8.5\times10^{-5}$ mole, $7.7\times10^{-4}$ mole and $2.5\times10^{-4}$ mole per mole of silver halide, respectively.

In addition, 4-hydroxy-6-methyl-1,3,3a,7-tetrazindene was added to the blue sensitive emulsion layer and the green sensitive emulsion layer in the amounts of $1\times10^{-4}$ mole and $2\times10^{-4}$ mole per mole of silver halide, respectively.

The following dyes were added to the emulsion layers for preventing irradiation. The numerals in the parentheses represent coating amounts.

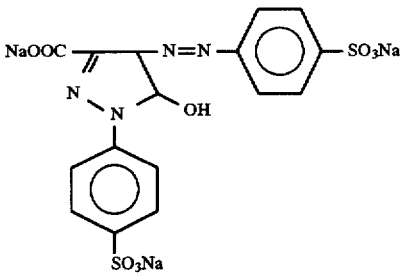

(10 mg/m²)

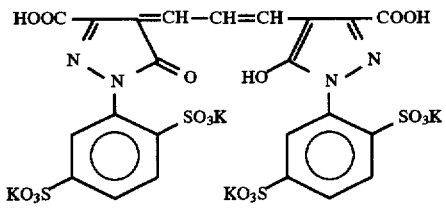

(10 mg/m²)

-continued

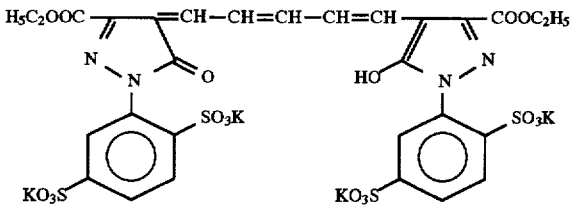

(40 mg/m²)

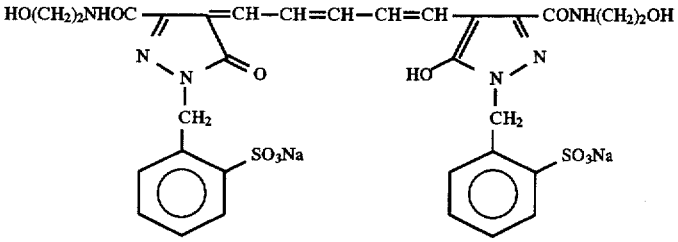

(20 mg/m²)

Layer constitution:

The composition of each layer is shown below. the numerals represent coating amount in terms of g/m². The coating amounts of silver halide emulsions are expressed in terms of the amount converted to silver amounts.

Support:

Polyethylene-laminated paper

The polyethylene layer at the first layer side contains a white pigment ($TiO_2$)and a bluing dye (ultramarine).

First layer (blue sensitive emulsion layer)

| | |
|---|---|
| Above-described silver chlorobromide emulsion A | 0.27 |
| Gelatin | 1.36 |
| Yellow dye-forming coupler (ExY-11) | 0.79 |
| Dye image stabilizer (Cpd-11) | 0.08 |
| Dye image stabilizer (Cpd-12) | 0.04 |
| Dye image stabilizer (Cpd-13) | 0.08 |
| Solvent (Solv-11) | 0.13 |
| Solvent (solv-12) | 0.13 |

Second layer (layer for preventing color mixing)

| | |
|---|---|
| Gelatin | 1.00 |
| Agent for preventing color mixing (Cpd-14) | 0.06 |
| Solvent (Solv-12) | 0.25 |
| Solvent (Solv-13) | 0.25 |
| Solvent (Solv-17) | 0.03 |

Third layer (green sensitive emulsion layer)

A silver chlorobromide emulsion was prepared in which the silver chlorobromide emulsion was a mixture of an emulsion B containing large size cubic grains having an average grain size of 0.55 μm and an emulsion B containing small size cubic grains having an average grain size of 0.39 μm at a silver molar ratio of 1:3. The fluctuation coefficients of grain size distribution of the emulsions were 0.10 and 0.08, respectively. Each emulsion contained locally 0.8 mole % of silver bromide on a part of the surface of grains consisting of silver chloride base grains.

| | |
|---|---|
| Silver chlorobromide emulsion | 0.13 |
| Gelatin | 1.45 |
| Magenta coupler (ExM-11) | 0.16 |
| Dye image stabilizer (Cpd-12) | 0.03 |

-continued

| | |
|---|---|
| Dye image stabilizer (Cpd-15) | 0.15 |
| Dye image stabilizer (Cpd-16) | 0.01 |
| Dye image stabilizer (Cpd-17) | 0.01 |
| Dye image stabilizer (Cpd-18) | 0.08 |
| Solvent (Solv-13) | 0.50 |
| Solvent (Solv-14) | 0.15 |
| Solvent (Solv-15) | 0.15 |

Fourth layer (layer for preventing color mixing)

| | |
|---|---|
| Gelatin | 0.70 |
| Agent for preventing color mixing (Cpd-14) | 0.04 |
| Solvent (Solv-12) | 0.18 |
| Solvent (Solv-13) | 0.18 |
| Solvent (Solv-17) | 0.02 |

Fifth layer (red sensitive emulsion layer)

A silver chlorobromide emulsion was prepared in which the chlorobromide emulsion was a mixture of an emulsion C containing large size cubic grains having an average grain size of 0.50 μm and an emulsion C containing small size cubic grains having an average grain size of 0.41 μm at a silver molar ratio of 1:4. The fluctuation coefficients of grain size distribution of the emulsions were 0.09 and 0.11, respectively. Each emulsion contained locally 0.8 mole % of silver bromide on a part of the surface of grains consisting of silver chloride base grains.

| | |
|---|---|
| Emulsion | 0.20 |
| Gelatin | 0.85 |
| Cyan coupler (ExC-11) | 0.33 |
| Ultraviolet ray absorbing agent (UV-12) | 0.18 |
| Dye image stabilizer (Cpd-11) | 0.33 |
| Dye image stabilizer (Cpd-16) | 0.01 |
| Dye image stabilizer (Cpd-18) | 0.01 |
| Dye image stabilizer (Cpd-19) | 0.01 |
| Dye image stabilizer (Cpd-20) | 0.01 |
| Dye image stabilizer (Cpd-21) | 0.01 |
| Solvent (Solv-11) | 0.01 |
| Solvent (Solv-16) | 0.22 |

Sixth layer (ultraviolet ray absorbing layer)

| | |
|---|---|
| Gelatin | 0.55 |
| Ultraviolet ray absorbing agent (UV-11) | 0.38 |
| Dye image stabilizer (Cpd-15) | 0.02 |
| Dye image stabilizer (Cpd-22) | 0.15 |

Seventh layer (protective layer)

| | |
|---|---|
| Gelatin | 1.13 |
| Acryl-modified copolymer of polyvinyl-alcohol (modification degree: 17%) | 0.05 |
| Liquid paraffin | 0.02 |
| Surface active agent (Cpd-23) | 0.01 |

Yellow dye-forming coupler (ExY-11)

A mixture at a molar ratio of 1:1 of:

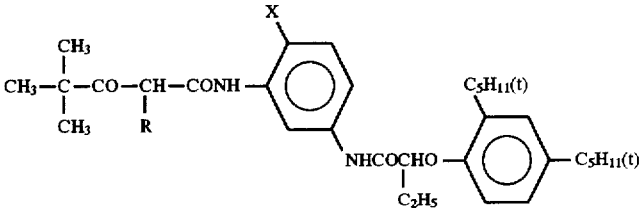

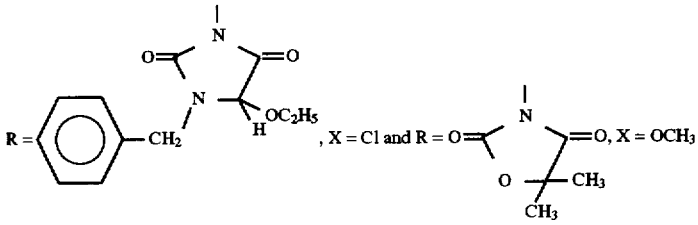

Magenta dye-forming coupler (ExM-11)

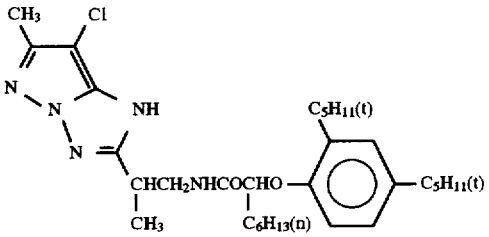

Cyan dye-forming coupler ((ExC-11)

A mixture at a molar ratio of 3:7 of:

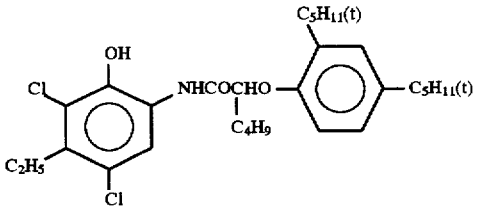

and

-continued

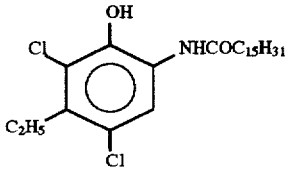

Dye image stabilizer (Cpd-11)

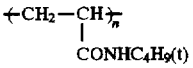

(Average molecular weight: 60,000)

Dye image stabilizer (Cpd-12)

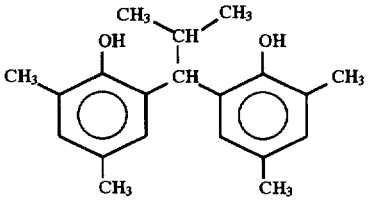

Dye image stabilizer (Cpd-13)
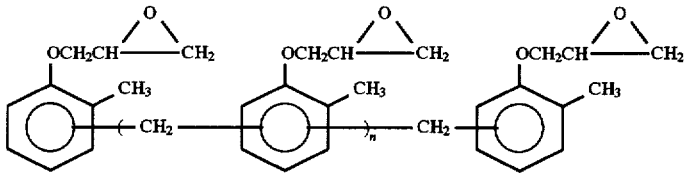
n = 7 to 8 (mean value)
Color mixing preventing agent (Cpd-14)
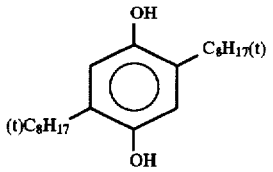
Dye image stabilizer (Cpd-15)
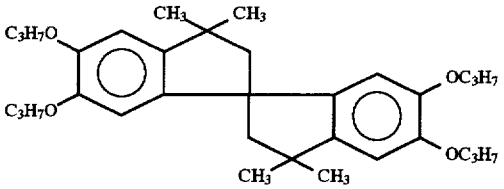
Dye image stabilizer (Cpd-16)
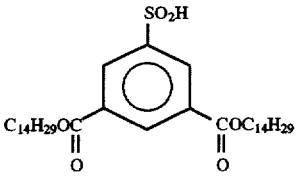
Dye image stabilizer (Cpd-17)
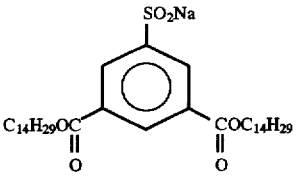
Dye image stabilizer (CPD-18)
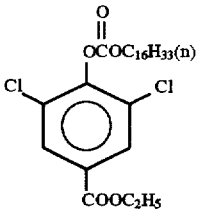
Dye image stabilizer (Cpd-19)
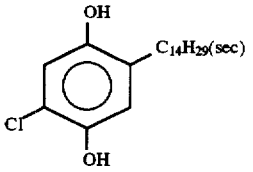
Dye image stabilizer (Cpd-20)
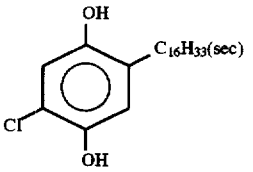
Dye image stabilizer (Cpd-21)
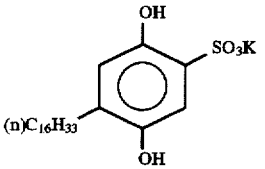
Dye image stabilizer (Cpd-22)
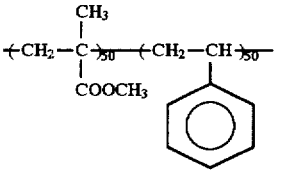
Surface active agent (Cpd-23)
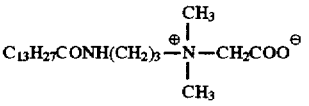
Preservative (Cpd-24)
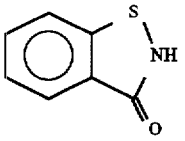

preservative (Cpd-15)

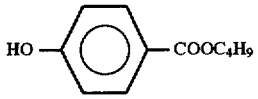

Ultraviolet ray absorbing agent (UV-11)

A mixture at a weight ratio of 1:5:10:5 of:

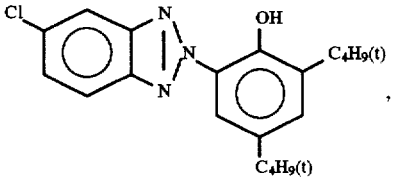

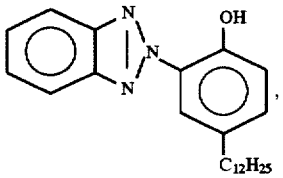

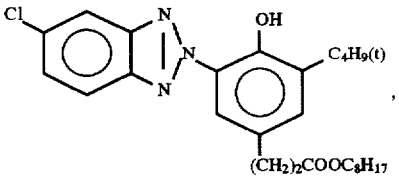

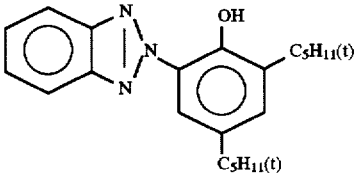

Ultraviolet ray absorbing agent (UV-12)

A mixture at a weight ratio of 1:2:2 of:

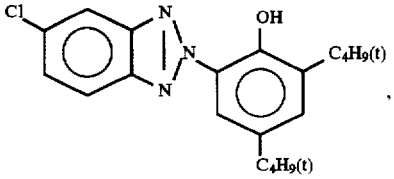

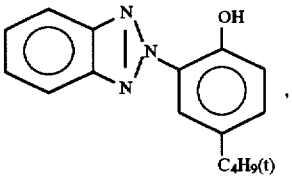

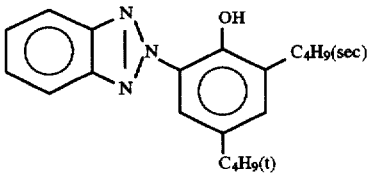

Solvent (Solv-11)

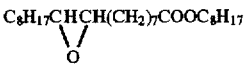

Solvent (Solv-12)

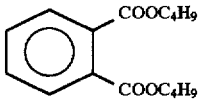

Solvent (Solv-13)

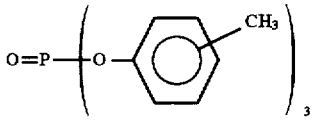

Solvent (Solv-14)

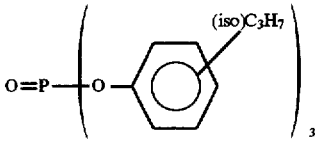

Solvent (Solv-15)

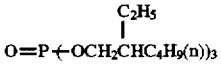

Solvent (Solv-16)

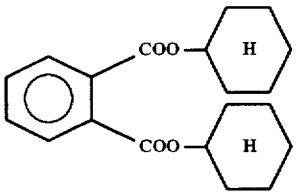

Solvent (Solv-17)

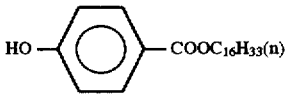

The color paper (Sample 201) prepared as described above was cut into a web roll of 89 mm in width.

As shown in FIG. 1, a consolidated develop-print processing apparatus in which a film processing apparatus and a paper processing apparatus were integrated into one in parallel with each other was prepared. The length of each rack in the respective processing tanks was made to be adjustable so as to be able to change the length of a path. The conveying speed of a film in the film processing apparatus and the conveying speed of a paper in the paper processing apparatus were made to be arbitrarily selectable by the use of variable motors in each drive unit.

In the film processing apparatus, a guide conveying method was used as described in FIG. 4 in Japanese Patent Application No. 6-82041. PPE-M1 (Modified polyphenylene ether resin strengthened with 30% glass fiber) was used as a material for the guide. The material has a coefficient of linear expansion of $3\times10^{-5}$ cm/cm ° C. The inner width of the groove of the guide was 1.0 mm and the depth of the groove was 4.0 mm.

In the printer portion, the same light source, the same printer and the same lens as those of a printer portion in a printer processor, Model PP1820V manufactured by Fuji Photo Film CO., Ltd. The printer has a capacity of printing 1,800 image frames per hour which have been exposed in a normal condition so that the printing time does not become the rate determining step in the entire steps of this experiment.

A color film 101 having imagewisely exposed 25 frames loaded into the film processing apparatus, and thereafter, film processing, printing and paper processing were carried out automatically in sequence. The length of path in each processing step and the conveying velocity were changed as described below. The time required for finishing 25 prints was measured. The results obtained are listed in Table 5. In Table 5, the length of paths is expressed in mm, and the conveying speed is expressed in terms of moving distance of the film or the paper in mm/second. The discharge time is the time from discharge of the first print to discharge of the 25th print from the drying zone. The developing-printing (DP) time is the time from the load of the film to the discharge of 25th print.

TABLE 5

| | Film Processing | | | Paper Processing | | | |
|---|---|---|---|---|---|---|---|
| No. | Path Length | Conveying Speed | Printing Time | Path Length | Conveying Speed | Discharge Time | DP Time |
| 01 | 6,000 | 15 | 15" | 6,000 | 40 | 78" | 10'43" |
| 02 | 4,500 | 15 | 15" | 4,500 | 40 | 78" | 8'26" |
| 03 | 3,000 | 15 | 15" | 4,500 | 40 | 78" | 6'20" |
| 04 | 2,600 | 15 | 15" | 3,000 | 40 | 78" | 5'41" |
| 05 | 1,200 | 8 | 30" | 1,400 | 20 | 156" | 8'06" |
| 06 | 5,000 | 25 | 10" | 5,000 | 40 | 78" | 8'13" |
| 07 | 1,500 | 8 | 30" | 1,000 | 15 | 208" | 8'13" |
| 08 | 4,000 | 22 | 12" | 6,000 | 110 | 28" | 4'36" |
| 09 | 2,600 | 10 | 23" | 3,000 | 10 | 317" | 15'00" |
| 10 | 2,700 | 15 | 15" | 2,400 | 40 | 78" | 5'33" |
| 11 | 720 | 4 | 30" | 800 | 10 | 317" | 10'07" |

In the film processing step, 100 rolls of the film were processed in the above processing conditions. The processing steps of the films and the compositions of the processing solutions are described below.

| Step | Ratio of Path Lengths | Processing Temperature | Quantity of Replenishing | Tank Capacity |
|---|---|---|---|---|
| Color Dev. | 1 | 42.0° C. | 260 ml | 10 1 |
| Bleach-Fix. | 1 | 38.0° C. | 520 ml | 10 1 |
| Stabilizing (1) | 0.5 | 38.0° C. | — | 5 1 |
| Stabilizing (2) | 0.5 | 38.0° C. | — | 5 1 |
| Stabilizing (3) | 0.5 | 38.0° C. | 520 ml | 5 1 |
| Drying | 1 | 60° C. | | |

The replenishing quantity is expressed in terms of ml per square meter of light sensitive material.

A counter current system from the stabilizing steps (3) to (1) was used in the stabilizing steps. The amount of carrying-over of the developing solution from the developing step to the bleach-fixing step, the amount of carrying-over of the bleach-fixing solution from the bleach-fixing step to the washing step were 1.7 ml and 1.4 ml per 24 mm in width and 1 m in length of film, respectively.

The composition of each of the processing solution was as follows:

| Color developer | Tank solution (g) | Replenishing solution (g) |
|---|---|---|
| Diethylenetriamine-pentaacetic acid | 2.0 | 2.0 |
| 1-Hydroxyethylidene-1,1'-diphosphonic acid | 2.0 | 2.0 |
| Sodium sulfite | 3.9 | 6.5 |
| Sodium carbonate | 37.5 | 39.0 |
| Potassium bromide | 1.5 | — |
| Potassium iodide | 1.3 mg | — |
| N,N-di(sulfonateethyl) hydroxyamine | 4.0 | 8.0 |
| 2-Methyl-4-[N-ethyl-N-(β-hyrdoxyethyl)amino] aniline sulfate | 6.5 | 10.0 |
| Water up to | 1 1 | 1 1 |
| pH(adjusted with potassium hydroxide and sulfuric acid) | 10.05 | 10.25 |

| Bleach-fixing solution | Tank solution (g) | Replenishing solution (g) |
|---|---|---|
| Ethylenediamine-2-carboxyphenyl)-N,N',N'-triacetic acid | 0.15 mole | 0.20 mole |
| Ferric chloride | 0.13 mole | 0.18 mole |
| Aqueous ammonium thiosulfate (700 g/l) | 200 ml | 330 ml |
| Ammonium iodide | 1.0 | — |
| Ammonium sulfite | 20.0 | 45.0 |
| Sodium benzene solfonic acid | 0.15 mole | 0.20 mole |
| Water up to | 1.0 1 | 1.0 1 |
| pH (adjusted with nitric acid and aqueous ammonia) | 6.0 | 5.5 |

| Stabilizing solution (the composition of the tank solution is common with that of the replenishing solution) (g) | |
|---|---|
| 1,2-Benzothiazoline-3-one | 0.05 |
| Polyoxyethylene-p-monononylphenyl ether (average degree of polymerization:10) | 0.2 |
| Disodium ethylenediamine-tetraacetic acid | 0.05 |
| 1,2,4-Triazole | 1.3 |
| 1,4-Bis(1,2,4-triazole-l-ylmethyl) piperazine | 0.75 |
| Sodium benzenesulfinic acid | 0.0001 mole |
| Water up to | 1 1 |
| pH (adjusted with NaoH and glycol acid) | 6.0 |

The film reaches a print-exposing surface in an approximate 45 mm of path length from the drying zone after the film is dried. The exposing light is twice reflected by two mirrors to reach the surface of the paper so that an print-exposure is effected as shown in FIG. 1.

The processing steps of the exposed paper is shown below.

| Step | Ratio of Path Length | Processing Temperature | Amount of Replenishing Solution | Tank Capacity |
|---|---|---|---|---|
| Color Dev. | 1 | 42.0° C. | 35 ml | 10 1 |
| Bleach-Fix. | 0.8 | 38.0° C. | 40 ml | 10 1 |
| Wash.(1) | 0.2 | 38.0° C. | — | 4 1 |
| Wash.(2) | 0.2 | 38.0° C. | — | 4 1 |
| Wash.(3) | 0.2 | 38.0° C. | — | 4 1 |
| Wash.(4) | 0.2 | 38.0° C. | — | 4 1 |
| Wash.(5) | 0.2 | 38.0° C. | 90 ml | 8 1 |
| Drying | 0.5 | 90° C. | | |

The amounts of replenishing solution are expressed in terms of ml/m$^2$ of light sensitive material.

A counter current system from the washing steps (5) to (1) was used in the washing steps. The amount of carrying-over of each processing solution was 35 ml/m$^2$. The composition of each of the processing solutions was as follows:

| Color developer | Tank solution | Replenishing solution |
|---|---|---|
| Water | 800 ml | 800 ml |
| Ethylenediamine-tetraacetic acid | 3.0 g | 3.0 g |
| Disodium 4,5-dihydroxybenzene-1,3-di-sulfonate | 0.5 g | 0.5 g |
| Potassium chloride | 8.5 g | — |
| Potassium bromide | 0.03 g | — |
| Potassium carbonate | 27.0 g | 27.0 g |
| Fluorescent Brightner (WHITEX 4; a product of Sumitomo Chemicals Co., Ltd.) | 1.0 g | 3.0 g |
| Sodium sulfite | 0.1 g | 0.1 g |
| Disodium N,N-bis(sulfonatoethyl) hydroxylamine | 5.0 g | 10.0 g |
| Dodium triisopropyl-naphthalene(β)sulfonate | 0.1 g | 0.1 g |
| N-Ethyl-N-(β-methane-sulfonamidoethyl-3-methyl-4-aminoaniline 3/2 sulfate monohydrate | 7.0 g | 15.5 g |
| Water up to | 1000 ml | 1000 ml |
| pH (adjusted with potassium hydroxide and sulfuric acid at 25° C.) | 10.00 | 11.30 |

| Bleach-fixing solution | Tank solution | Replenishing solution |
|---|---|---|
| Water | 600 ml | 150 ml |
| Aqueous ammonium thiosuifate (750 ml/l) | 93 ml | 230 ml |
| Ammonium sulfite | 40 g | 100 g |
| Ferric ammonium ethylenediamine tetra-acetate | 55 g | 135 g |
| Nitric acid (67%) | 30 g | 65 g |
| Water up to | 1000 ml | 1000 ml |
| pH (adjusted with acetic acid and aqueous ammonia) | 5.2 | 4.8 |
| Rinse solution (the composition of the tank solution is the same as that of the replenishing solution) | | |
| Chlorinated isocyanuric acid | | 0.02 |
| Deionized water (electroconductivity: less than 5 μs/cm) | | up to 1000 ml |
| pH | | 6.5 |

Each of the films and the papers processed under the print-processing conditions in Table 5 above was evaluated as follows.

[Film Jamming]

The number of films which were jammed in the processing of 100 rolls of the films was determined.

[Measurement of accuracy in reading magnetic records]

FM signals were recorded on the magnetic recording layer of Sample 101 between the perforations of the photosensitive material from the side of the magnetic recording layer by the use of a head capable of inputting and outputting, having 5 μm of a head gap and 200 of turn numbers, at a speed of 100 mm/second.

After recording the FM signals, the emulsion layer was uniformly exposed at 1,000 cms, thereafter the photosensitive material was processed by the above-described process. The photosensitive material was accommodated in the same cartridge again.

The film was drawn out from the cartridge, and the signals were read by the head at the same speed as the speed when the signals were recorded. In order to examine whether the signals were correctly output, a ratio of bit numbers in error to the input bit numbers was determined. The ratio in error of 0.1 or more was not acceptable. The ratio of 0.05 or less, preferably 0.01 or less, more preferably 0.008 or less was acceptable. When the ratios are such low values, there is no practical problem.

[Evaluation on scratches on film]

100 rolls of the processed films were visually judged and graded in the following four levels.

⊙: no scratches on all of 100 rolls of films;

○: there were scratched films in the 100 rolls of the films, but scratches were not observed on the prints printed from the films;

Δ: there were scratched films in the 100 rolls of the films, but scratches were observed on the prints printed from the films at a probability of 0.5% or less; and x: there were scratched films in the 100 rolls of the films, but scratches were observed on the prints printed from the films at a probability of more than 0.5%.

[Evaluation on sinking of processing solution from the edges of the paper support]

50 sheets of processed papers were stacked and maintained at 80° C. and 70% RH for one week. The increase of density in edge portions of the paper was determined by measuring yellow density. The degree of sinking of processing solution is high, the yellow density increases.

[Streaks in the trailing end of the paper]

Streaks of in the trailing end of the paper are caused by the flow of the developer at the cross-over portion between the developing station and the bleach-fixing station. 500 sheets of processed print paper were inspected and the number of prints having streaks was counted.

⊙: no streaks on 500 sheets of the paper;

○: streaks were found on 1 to 3 sheets of 500 sheets;

Δ: streaks were found on 4 to 5 sheets of 500 sheets; and x: streaks were found on 6 or more sheets of 500 sheets.

The results obtained are shown in Table 6.

TABLE 6

| | Properties of Film | | | Performance of Paper | | |
|---|---|---|---|---|---|---|
| No. | Jamming | Accuracy of Magnetic Recording | Scratch | Sinking of Processing Solution | Streaks | Remarks |
| 01 | 7 | 0.23% | x | 0.23 | Δ | C.E. |
| 02 | 0 | 0.007 | Δ | 0.17 | ○ | P.I. |
| 03 | 0 | 0.002 | ◎ | 0.18 | ○ | P.I. |
| 04 | 0 | 0.003 | ◎ | 0.14 | ◎ | P.I. |
| 05 | 0 | 0.006 | ○ | 0.19 | Δ | P.I. |
| 06 | 1 | 0.009 | Δ | 0.18 | ○ | P.I. |
| 07 | 0 | 0.005 | ○ | 0.18 | Δ | P.I. |
| 08 | 1 | 0.010 | Δ | 0.22 | ○ | P.I. |
| 09 | 0 | 0.005 | ○ | 0.20 | x | C.E. |
| 10 | 0 | 0.002 | ◎ | 0.14 | ◎ | P.I. |
| 11 | 6 | 0.14 | ○ | 0.19 | x | C.E. |

P.I denotes Samples according to the present invention and C.E. denotes Samples of comparative examples.

As shown in Table 6, in the developing and printing (DP) time within ten minutes in accordance with the present invention, jamming and scratches of the films did not arise, and the accuracy of reading information of magnetic records was not deteriorated. Further, in the properties of the prints, the sinking of the processing solution from the edges of the paper support and the streaks in the trailing end of the paper were not found. In particular, the most preferable results were obtained in Sample Nos. 3, 4 and 10 which were processed in 5 to 8 minutes of the developing and printing (DP) time.

Jamming of the film was apt to occur when the length of path was longer and the conveying speed was considerably slow.

The accuracy of reading information of magnetic records deteriorated when the length of path was longer and the conveying speed was considerably slow. It is presumed that the scratches tend to occur when the length of path is longer, and stains and the like tend to occur due to insufficient cleaning of the surface of the film when the conveying speed of the film is slow. The scratches of the film were apt to occur when the length of path was longer and the conveying speed of the film was faster. As mentioned above, Sample Nos. 2, 3, 4, 5, 7, 9, and 10 which were within the preferred ranges of the length of path and the conveying speed of the film showed good results, Sample Nos. 3, 4 and 10 which were within the most preferred range of the length of path and the conveying speed of the film showed the most preferred results.

The sinking of processing solution from the edge portions of the support was deteriorated when the length of path was longer and the conveying speed was extremely slow.

The streaks at the trailing end portion of the paper were apt to arise when the length of path was longer and the conveying velocity was slower.

As mentioned above, preferred results were obtained in Sample Nos. 2, 3, 4, 5, 6, 7 and 10 which were within the preferred ranges of the length of path and the conveying speed. In particular, the most preferred results were obtained in Sample Nos. 4 and 10 which were within the most preferred range of the length of path and the conveying speed.

EXAMPLE 2

In place of Sample 101, Samples 102 and 103, supports of which were different from that of Sample 101, were processed by the processes of Nos. 1, 3, 4 and 10 of Example 1, and jamming, accuracy of magnetic recording and scratches of Samples 102 and 103 were evaluated. The results thus obtained are shown in Table 7.

TABLE 7

| | | Properties of Film | | | |
|---|---|---|---|---|---|
| Process No. | Sample | Jamming | Accuracy of Magnetic Recording | Scratches | Remarks |
| 01 | 101A | 7 | 0.23% | X | C. E. |
| 03 | 101B | 0 | 0.002 | ◎ | P. I. |
| 04 | 101C | 0 | 0.003 | ◎ | P. I. |
| 10 | 101D | 0 | 0.002 | ◎ | P. I. |
| 01 | 102A | 7 | 0.23% | X | C. E. |
| 03 | 102B | 1 | 0.007 | ○ | P. I. |
| 04 | 102C | 1 | 0.008 | ○ | P. I. |
| 10 | 102D | 1 | 0.008 | ○ | P. I. |
| 01 | 103A | 7 | 0.22% | X | C. E. |
| 03 | 103B | 1 | 0.006 | ○ | P. I. |
| 04 | 103C | 1 | 0.007 | ○ | P. I. |
| 10 | 103D | 1 | 0.007 | ○ | P. I. |

C. E. stands for samples in accordance with comparative examples and P.I. stands for samples in accordance with the present invention.

As shown in Table 7, properties of jamming, accuracy of magnetic recording and scratches of Samples 101B, 101C and 101D, which have A-PEN supports and processed by processes 03, 04 and 10, respectively, were most preferable.

EXAMPLE 3

In the paper processing in Example 1, the pH values of the bleach-fixing solution were changed as shown in Table 8, and Samples were processed by the processes of 1, 4 and 10 of Example 1.

TABLE 8

| | | pH Values of Bleach-Fixing Solution | | Properties of Processed Paper | | |
|---|---|---|---|---|---|---|
| No. | Process | Tank Solution | Replenisher | Sinking of Processing | Streaking | Remarks |
| 31 | 01 | 4.0 | 3.5 | 0.23 | Δ | C. E. |
| 32 | 01 | 4.5 | 4.0 | 0.23 | Δ | C. E. |
| 33 | 01 | 5.0 | 4.5 | 0.23 | Δ | C. E. |
| 34 | 01 | 5.5 | 5.0 | 0.22 | Δ | C. E. |
| 35 | 01 | 6.0 | 5.5 | 0.22 | Δ | C. E. |
| 36 | 01 | 6.5 | 6.0 | 0.22 | X | C. E. |
| 37 | 04 | 4.0 | 3.5 | 0.18 | ○ | P. I. |
| 38 | 04 | 4.5 | 4.0 | 0.14 | ◎ | P. I. |
| 39 | 04 | 5.0 | 4.5 | 0.14 | ◎ | P. I. |
| 40 | 04 | 5.5 | 5.0 | 0.14 | ◎ | P. I. |
| 41 | 04 | 6.0 | 5.5 | 0.16 | ○ | P. I. |
| 42 | 04 | 6.5 | 6.0 | 0.18 | ○ | P. I. |
| 43 | 10 | 4.0 | 3.5 | 0.19 | ○ | P. I. |
| 44 | 10 | 4.5 | 4.0 | 0.14 | ◎ | P. I. |
| 45 | 10 | 5.0 | 4.5 | 0.14 | ◎ | P. I. |
| 46 | 10 | 5.5 | 5.0 | 0.14 | ◎ | P. I. |
| 47 | 10 | 6.0 | 5.5 | 0.16 | ○ | P. I. |
| 48 | 10 | 6.5 | 6.0 | 0.17 | ○ | P. I. |

C. E. stands for samples in accordance with comparative examples and P. I. stands for samples in accordance with the present invention.

Sinking of the processing solution from the edges of the paper and streaks at the trailing end of the paper in the present invention are small, in particular, the most preferable results were obtained when the pH values of the tank solution of the bleach-fixing solution were in the range of 4.5 to 5.5.

EXAMPLE 4

The material and the shape of the film conveying guide of the film processing apparatus in Example 1 were changed to form a conveying rack as shown in Tables 9A. Sample 101 were processed with the processes No. 1 and 2 by the apparatus above. The jamming, accuracy of magnetic recording and scratches of the processed films were evaluated. The results obtained are shown in Table 9B.

TABLE 9 A

| No. | Process | Material of Guide | Coefficient of Linear Expansion × $10^{-5}$ cm/cm °C. | Shape of Width of Groove | Guide Depth of Groove |
|---|---|---|---|---|---|
| 51 | 01 | PP | 11.0 | 2.0 | 3.0 |
| 52 | 01 | PVC | 7.0 | 2.0 | 3.0 |
| 53 | 01 | PPE-M1 | 3.0 | 2.0 | 3.0 |
| 54 | 01 | PPE-M2 | 3.6 | 2.0 | 3.0 |
| 55 | 01 | PPE-M/PPS | 1.5 | 2.0 | 3.0 |
| 56 | 01 | PVC | 7.0 | 6.0 | 3.0 |
| 57 | 01 | PPE-M1 | 3.0 | 6.0 | 3.0 |
| 58 | 01 | PPE-M1 | 3.0 | 2.0 | 6.0 |
| 59 | 01 | PPE-M1 | 3.0 | 2.0 | 1.0 |
| 60 | 01 | PPE-M/PPS | 1.5 | 6.0 | 3.0 |
| 61 | 01 | PPE-M/PPS | 1.5 | 2.0 | 6.0 |
| 62 | 01 | PPE-M/PPS | 1.5 | 2.0 | 1.0 |
| 63 | 10 | PP | 11.0 | 2.0 | 3.0 |
| 64 | 10 | PVC | 7.0 | 2.0 | 3.0 |
| 65 | 10 | PPE-M1 | 3.0 | 2.0 | 3.0 |
| 66 | 10 | PPE-M2 | 3.6 | 2.0 | 3.0 |
| 67 | 10 | PPE-M/PPS | 1.5 | 2.0 | 3.0 |
| 68 | 10 | PVC | 7.0 | 6.0 | 3.0 |
| 69 | 10 | PPE-M1 | 3.0 | 6.0 | 3.0 |
| 70 | 10 | PPE-M1 | 3.0 | 2.0 | 6.0 |
| 71 | 10 | PPE-M1 | 3.0 | 2.0 | 1.0 |
| 72 | 10 | PPE-M/PPS | 1.5 | 6.0 | 3.0 |
| 73 | 10 | PPE-M/PPS | 1.5 | 2.0 | 6.0 |
| 74 | 01 | PPE-M/PPS | 1.5 | 2.0 | 1.0 |

PP stands for polypropylene resin, PVC stands for hard polyvinylchloride resin, PPE-M1 stands for modified polyphenyleneether resin reinforced with 30% glass fiber, PPE-m2 stands for modified polyphenyleneether resin reinforced with 10% glass fiber, and PPE-M/PPS stands for a resin of a polymer alloy of modified polyphenyleneether and polyphenylsulfide reinforced with 30% glass fiber.

TABLE 9 B

| | Properties of Film | | | |
|---|---|---|---|---|
| No. | Jamming | Characteristics of Magnetic Recording | Scratches | Remarks |
| 51 | 7 | 0.23 | x | C. E. |
| 52 | 7 | 0.22 | x | C. E. |
| 53 | 7 | 0.24 | x | C. E. |
| 54 | 7 | 0.24 | x | C. E. |
| 55 | 7 | 0.23 | x | C. E. |
| 56 | 8 | 0.23 | x | C. E. |
| 57 | 8 | 0.22 | x | C. E. |
| 58 | 8 | 0.24 | x | C. E. |
| 59 | 8 | 0.23 | x | C. E. |
| 60 | 7 | 0.24 | x | C. E. |
| 61 | 7 | 0.22 | x | C. E. |
| 62 | 7 | 0.23 | x | C. E. |
| 63 | 3 | 0.009 | ○ | P. I. |
| 64 | 2 | 0.008 | ○ | P. I. |
| 65 | 0 | 0.002 | ◎ | P. I. |
| 66 | 0 | 0.002 | ◎ | P. I. |
| 67 | 0 | 0.002 | ◎ | P. I. |
| 68 | 3 | 0.010 | ○ | P. I |
| 69 | 1 | 0.005 | ○ | P. i. |
| 70 | 1 | 0.005 | ○ | P. I. |

TABLE 9 B-continued

| | Properties of Film | | | |
|---|---|---|---|---|
| No. | Jamming | Characteristics of Magnetic Recording | Scratches | Remarks |
| 71 | 1 | 0.005 | ○ | P. I. |
| 72 | 1 | 0.004 | ◎ | P. I. |
| 73 | 1 | 0.006 | ◎ | P. I. |
| 74 | 1 | 0.005 | ◎ | P. I. |

C. E. stands for samples in comparative examples and P. I. stands for samples in accordance with the present invention.

Preferred results were obtained in the Samples in accordance with the present invention, in particular, the most preferable results were obtained in Sample Nos. 65, 66 and 67 in which the guides which have the coefficients of linear expansion in the range of $1.0\times10^{-5}$cm/cm° C. to $6.0\times10^{-5}$ cm/cm° C., the inner width of the groove in the range of 0.5 mm to 5.0 mm, and the depth of the groove in the range of 2 mm to 5 mm were used.

As described above, the present invention provides a color photographic processing method and apparatus in which color films and color papers can successively be processed in a short period of time without troubles in conveying the films and/or the papers.

What is claimed is:

1. A color photographic processing apparatus in which a color film processing apparatus, a printer and a color paper processing apparatus are built-in in a casing, characterized in that the sum of a length of a path from an entrance of a developing tank to a discharge port of a drying station of the color film processing apparatus and a length of a path from an entrance of a developing tank to a discharge port of a drying station of the color paper processing apparatus is in the range of 950 mm to a processing time from insertion of an exposed color film into the color film processing apparatus to discharge of the 25th finished print or equivalent thereto through the processing of the color film, the print-exposure onto the color paper and the processing of the color paper is less than 10 minutes, a ratio NV of the length of the path (mm) to the conveying speed of the color film (mm/second) is from 120–330, and a ratio PV of the length of the path (mm) to the conveying speed of the color film (mm/second) is from 20–120.

2. A color photographic processing apparatus according to claim 1, wherein the processing time from insertion of an exposed color film into the color film processing apparatus to discharge of the 25th finished print or equivalent thereto through the processing of the color film, the print-exposure onto the color paper and the processing of the color paper is in the range of 5 to 8 minutes.

3. A color photographic processing apparatus according to claim 1, wherein of the length of the path from the entrance of the developing tank to the discharge port of the drying station of the color film processing apparatus is in the range of 750 mm to 4,500 mm, and the conveying speed of the color film in the color film processing apparatus is in the range of 5 to 20 mm/second.

4. A color photographic processing apparatus according to claim 3, wherein the color film comprises a polyester support.

5. The apparatus of claim 3 wherein said length is 1,500–4,500 mm.

6. The apparatus of claim 3 wherein said conveying speed is 10–20 mm/sec.

7. A color photographic processing apparatus according to claim 1, wherein of the length of the path from the entrance of the developing tank to the discharge port of a drying station of the color paper processing apparatus is in the range of 750 mm to 4,500 mm, and the conveying speed of the color paper in the color paper processing apparatus is in the range of 12 to 100 mm/second.

8. The apparatus of claim 7 wherein said length is 2,000–4,000 mm.

9. A color photographic processing apparatus according to claim 1, wherein the length of the path from the entrance of the developing tank to the printer of the color film processing apparatus is in the range of 100 mm to 1,000 mm, and the conveying speed of the color film in the color film processing apparatus is in the range of 5 to 20 mm/second.

10. A color photographic processing apparatus according to claim 1, wherein the conveying system of the color film in the color film processing apparatus comprises a guide and a roller.

11. A color photographic processing apparatus according to claim 10, wherein the inner width of the guide is more than 0.5 mm and less than 5.0 mm, and the depth of the guide is more than 2 mm and less than 5 mm.

12. A color photographic processing apparatus according to claim 11, wherein the coefficient of linear expansion of the material constituting the guide is less than $1\times10^{-5}$ (cm/cm° C.) and more than $-1\times10^{-5}$ (cm/cm° C.).

13. A color photographic processing apparatus according to claim 12, wherein the material constituting the guide is at least one of homopolymer and polymer alloy selected from the groups of polyphenyleneether resins and polyphenyleneoxide resins.

14. A color photographic processing apparatus according to claim 1, wherein a means for reading information recorded on a magnetic recording layer on the color film is provided in the casing.

15. The apparatus of claim 1 wherein said apparatus has a projection area of less than 1 $m^2$.

16. The apparatus of claim 1 wherein said ratio 150–270.

17. The apparatus of claim 1 wherein said conveying speed is 25–80 mm/sec.

18. A color photographic processing method in which a color film processing apparatus, a printer and a color paper processing apparatus are built-in in a casing, characterized in that the sum of a length of a path from an entrance of a developing tank to a discharge port of a drying station of the color film processing apparatus and a length of a path from an entrance of a developing tank to a discharge port of a drying station of the color paper processing apparatus is in the range of 950 mm to 10,000 mm, a processing time from insertion of an exposed color film into the color film processing apparatus to discharge of the 25th finished print or equivalent thereto through the processing of the color film, the print-exposure onto the color paper and the processing of the color paper is less than 10 minutes, a ratio NV of the length of the path (mm) to the conveying speed of the color film (mm/speed) is from 120 to 330, and a ratio PV of the length of the path (mm) to the conveying speed of the color paper (mm/second) is from 20 to 120.

19. A color photographic processing method according to claim 18, wherein the processing time from insertion of an exposed color film into the color film processing apparatus to discharge of the 25th finished print or equivalent thereto through the processing of the color film, the print-exposure onto the color paper and the processing of the color paper is in the range of 5 to 8 minutes.

20. A color photographic processing method according to claim 18, wherein the length of the path from the entrance of the developing tank to the discharge port of a drying station of the color film processing apparatus is from 750 mm to 4,500 mm, and the conveying speed of the color film in the color film processing apparatus is in the range of 5 to 20 mm/second.

21. A color photographic processing method according to claim 16, wherein the color film comprises a polyester support.

22. A color photographic processing method according to claim 18, wherein the sum of the length of the path from the entrance of the developing tank to the discharge port of a drying station of the color paper processing apparatus is in the range of 750 mm to 4,500 mm, and the conveying speed of the color paper in the color paper processing apparatus is in the range of 12 to 100 mm/second.

23. A color photographic processing method according to claim 18, wherein the length of the path from the entrance of the developing tank to the printer of the color film processing apparatus is in the range of 100 mm to 1,000 mm, and the conveying speed of the color film in the color film processing apparatus is in the range of 5 to 20 mm/second.

24. A color photographic processing method according to claim 18, wherein the conveying system of the color film in the color film processing apparatus comprises a guide and a roller.

25. A color photographic processing method according to claim 24, wherein the inner width of the guide is more than 0.5 mm and less than 5.0 mm, and the depth of the guide is more than 2 mm and less than 5 mm.

26. A color photographic processing method according to claim 24, wherein the coefficient of linear expansion of the material constituting the guide is less than $1\times10^{-5}$ (cm/cm° C.) and more than $-1\times10^{-5}$ (cm/cm° C.).

27. A color photographic processing method according to claim 26, wherein the material constituting the guide is at least one of homopolymer and polymer alloy selected from the groups of polyphenyleneether resins and polyphenyleneoxide resins.

28. A color photographic processing method according to claim 18, wherein a means for reading information recorded on a magnetic recording layer on the color film is provided in the casing.

* * * * *